US006869209B2

(12) United States Patent
Layne et al.

(10) Patent No.: US 6,869,209 B2
(45) Date of Patent: Mar. 22, 2005

(54) ASSEMBLY FOR A WEDGE BASE TRACK LAMP HOLDER

(75) Inventors: Bruce Layne, Wheaton, IL (US); James V. Agro, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 163 days.

(21) Appl. No.: 09/917,205

(22) Filed: Jul. 30, 2001

(65) Prior Publication Data

US 2002/0064049 A1 May 30, 2002

Related U.S. Application Data

(60) Provisional application No. 60/221,570, filed on Jul. 28, 2000, provisional application No. 60/221,569, filed on Jul. 28, 2000, provisional application No. 60/221,568, filed on Jul. 28, 2000, provisional application No. 60/221,567, filed on Jul. 28, 2000, provisional application No. 60/221,565, filed on Jul. 28, 2000, provisional application No. 60/221,564, filed on Jul. 28, 2000, and provisional application No. 60/221,563, filed on Jul. 28, 2000.

(51) Int. Cl.[7] ..... F21V 21/14

(52) U.S. Cl. ..... 362/404; 362/287; 362/226; 362/147

(58) Field of Search ..... 362/147, 404, 362/249, 226, 427, 287, 247; 439/110, 116, 856; 174/99 B; 200/227, 51.07

(56) References Cited

U.S. PATENT DOCUMENTS

| | | | | | |
|---|---|---|---|---|---|
| 3,718,816 | A | * | 2/1973 | Seelbach et al. | 362/249 |
| 4,190,309 | A | * | 2/1980 | Glass | 439/118 |
| 4,262,980 | A | | 4/1981 | Heritage | |
| 4,676,567 | A | * | 6/1987 | Mouchi | 439/207 |
| 4,957,455 | A | | 9/1990 | Horiuchi et al. | |
| 5,259,774 | A | * | 11/1993 | Gabrius | 439/110 |
| D344,262 | S | | 2/1994 | Bray | |
| D362,656 | S | | 9/1995 | Roos et al. | |
| 5,709,571 | A | | 1/1998 | Briski et al. | |
| 5,772,315 | A | * | 6/1998 | Shen | 362/396 |
| 5,876,249 | A | | 3/1999 | Kim | |
| 6,033,097 | A | * | 3/2000 | Harwood | 362/404 |
| 6,170,967 | B1 | * | 1/2001 | Usher et al. | 362/394 |
| 6,203,339 | B1 | * | 3/2001 | Nieminen | 439/118 |

* cited by examiner

*Primary Examiner*—Thomas M. Sember
(74) *Attorney, Agent, or Firm*—Thomas, Kayden, Horstemeyer & Risley LLP

(57) ABSTRACT

A wedge base track lamp holder assembly includes a base, at least one conductive contact member, and a retention piece. The base includes a first channel with an opening at one end of the base, a second channel extending away from the first channel and having an opening at an end opposite the first channel, and an adaptor portion extending from the base and enclosing part of the second channel. The conductive contact members are insertable within the first channel and the second channel. The retention piece in insertable within the second channel and configured to retain the conductive contact members within the first channel and the second channel.

15 Claims, 32 Drawing Sheets

FIG. 34
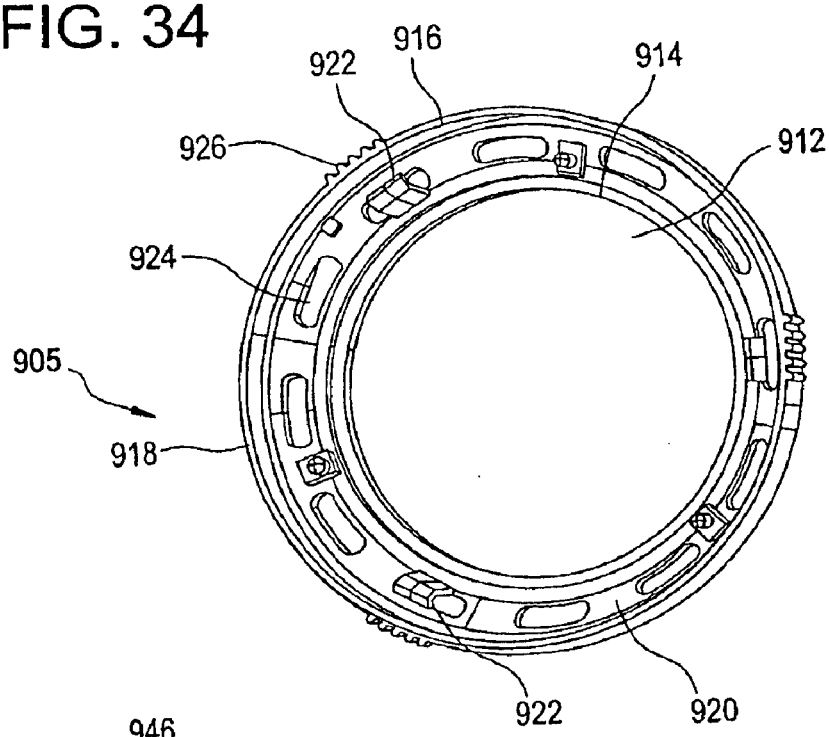
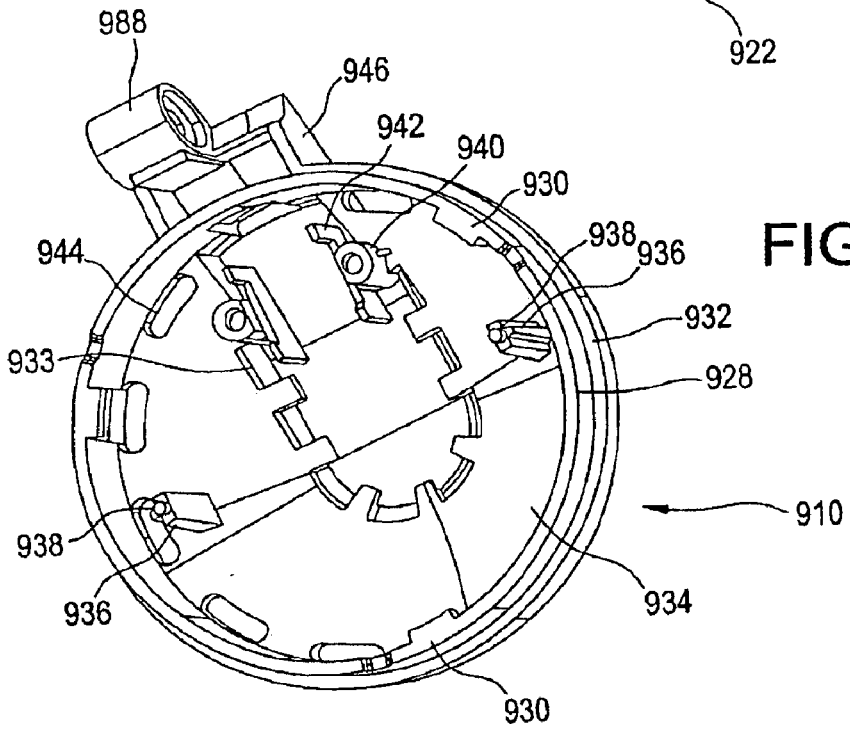
FIG. 35

ASSEMBLY FOR A WEDGE BASE TRACK LAMP HOLDER

CROSS REFERENCE TO RELATED APPLICATIONS

This application claims priority from U.S. Provisional Application No. 60/102,156 filed Jul. 28, 2000; U.S. Provisional Application No. 60/221,564, filed Jul. 28, 2000; U.S. Provisional Application No. 60/221,565, filed Jul. 28, 2000; U.S. Provisional Application No. 60/221,567, filed Jul. 28, 2000; U.S. Provisional Application No. 60/221,568, filed Jul. 28, 2000; U.S. Provisional Application No. 60/221,569, filed Jul. 28, 2000; and U.S. Provisional Application No. 60/221,570, filed Jul. 28, 2000, all of which are incorporated by reference.

TECHNICAL FIELD

This invention relates to track lighting systems and more particularly to an assembly for a wedge base track lamp holder.

BACKGROUND

Track lighting systems allow installation of light fixtures using a single set of track conductors. Track lighting systems can provide light over a wide area and can be used to accentuate specific objects within a room. Thus, track lighting systems are widely used both in private residences as well as in publicly accessible buildings, such as commercial establishments and museums.

Track lighting systems come in a variety of shapes, sizes, and configurations. More commonly, the track frame is configured as an elongated rectangle or strip. Track lighting systems typically include spot light fixtures that are inserted along the narrow, electrified track frame. One side of the track frame mounts to a ceiling or wall and the side opposite the mounting surface usually has an opening along the length of the track frame for inserting light fixtures. The component of the light fixture that inserts into the track usually provides both an electrical connection with the track conductors and a mechanical connection to secure the fixture.

SUMMARY

In one general aspect, a wedge base track lamp holder assembly includes a base, at least one conductive contact member, and a retention piece. The base includes a first channel with an opening at one end of the base, a second channel extending away from the first channel and having an opening at an end opposite the first channel, and an adaptor portion extending from the base and enclosing part of the second channel. The conductive contact member is insertable within the first channel and the second channel. The retention piece is insertable within the second channel and is configured to retain the conductive contact member within the first channel and the second channel.

In other implementations, the wedge base track lamp holder may include one or more of the following features. For example, the first channel may include conductor slots running along the length of the first channel. The conductive contact member may include a first portion and a second portion extending from the first portion, and the first portion of the conductive contact member may fit within the conductor slot and the second portion may fit within the second channel.

The conductor slot may include an upper wall and a lower wall and the conductive contact member may include an upper contact and a lower contact. When the first portion of the conductive contact member is positioned within the conductor slot, the upper contact may be adjacent to the upper wall and the lower contact may be adjacent to the lower wall.

The second channel may include a second conductor slot running along the length of the second channel. The second portion of the conductive contact member may fit within the second conductor slot. The retention piece may retain the second portion of the conductive contact member within the second conductor slot in the second channel. The second conductor slot in the second channel may have a back wall and two side walls. The adaptor portion may have a wider opening at the second conductor slot than at a region of the adaptor portion adjacent to the second conductor slot. The retention piece may include a wider portion configured to fit within the second conductor slot and a narrower portion configured to fit within the region of the adaptor portion adjacent to the second conductor slot.

The wedge base lamp holder may further include a retention piece slot in the second channel and a protrusion extending from the retention piece. The protrusion may be configured to fit within the retention piece slot when the retention piece is inserted into the second channel. Insertion of the protrusion into the retention piece slot may restrict lateral movement of the retention piece.

The adaptor portion may include at least one adaptor slot running in a direction that is generally perpendicular to the second channel and the retention piece may include at least one protrusion that is configured to fit within the adaptor slot. A generally horizontal upper wall and an angled lower wall may define the adaptor slot. The protrusion on the retention piece may have an opposite shape of the adaptor slot such that the protrusion slides into the adaptor slot in one direction but is prevented from being pulled out in the other direction. The adaptor portion also may include an outward extension and the adaptor slot may further extend along the outward extension. The adaptor portion also may include a pair of wings that are configured to be mated to a track lighting network.

The base may include a base slot in a lower surface of the first channel and the first channel may have openings at both ends of the base. The retention piece may include an extension extending from a lower surface of the retention piece and may be configured to fit within the base slot in the lower surface when the retention piece is inserted into the second channel. Inserting the extension into the base slot may restrict lateral movement of the retention piece.

The wedge base track lamp holder also may have a reflector or reflectors that include an aperture and may be configured to hold one or two lamps. The retention piece may include an arm extending from the retention piece in a first direction and a tab extending from the arm in a second direction. When the retention piece is inserted in the second channel, the tab may be inserted into the aperture in the reflector to retain the reflector to the base.

In another general aspect, a method of forming a wedge base track lamp holder includes providing the base, the conductive contact member, and the retention piece described above, inserting the conductive contact member within the first channel and the second channel, and inserting the retention piece within the second channel to retain the conductive contact member in the base.

The track light system includes relatively few parts and is designed for easy and rapid assembly. The track lighting system provides a lower profile with aesthetically pleasing fixtures and components. Another version of the track light system provides a larger, more rigid track frame in applications where additional mechanical strength is necessary, such as, for example, suspended applications.

The track connector includes contact blocks that integrate the track frames by making both electrical and mechanical connections with the track conductors. The connections between the various components are securely fastened by compressive as well as penetrating forces. Thus, once the track light system is installed, the electrical connections and mechanical integrity are extremely reliable and require little or no maintenance. The track connectors also have a variety of shapes for flexibility in shape and construction of the track system on various surfaces.

The light fixture interface provides a low profile, quick connect/disconnect device for attaching the track light fixture to the track frame. Once installed, the interface provides a secure mechanical connection and a reliable electrical connection. The interface allows a track light fixture to be removed or adjusted without fear of contact with the electrical conductors.

The track lighting system is designed to accommodate an array of different light fixtures that can produce a variety of lighting effects. For example, the wedge base track fixture and the rotation lock housing fixture have compact designs and a minimal number of parts, and are suitable for under-cabinet and task lighting applications. The rotation-lock housing fixture has the added benefit of a pivot mechanism that permits rotation of the light source for illumination of a specific area.

The light fixtures are designed for use with high intensity lamps. Low-voltage halogen light can be used for dramatic emphasis while protecting against fading and light damage. Many of the light fixtures are suitable for use as accent and spotlights as they can be adjusted or aimed by using a pivot mechanism and other aiming features. The pivot mechanism has components that are fastened together in a manner that prevents use and wear from causing the components to separate or become loose. The pivot mechanism also is durable, has aesthetic symmetry as a component of the light fixture, and is designed with a minimal number of parts.

The light fixture with integral constant tension and rotation stop is light-weight, easy to manufacture, has a minimal number of parts, and resists wear. The wear-resistant feature provides constant tension between the aiming arm and the lamp retaining ring to prevent looseness or laxity between these components. Thus, the lamp retaining ring is rotatable to a fixed position and will maintain that fixed position even after extended use.

The track light system is designed to accept high wattage loads at 24 volts so that the track network can be very long with a greater number of light fixtures and lamp holders. Installed costs are lower in comparison to either 120-volt track systems with low-voltage lamp holders or to dedicated 12-volt track systems. The effects of voltage drops caused by line losses are reduced in 24-volt systems. Lamp and fixture current also are lower when operated at 24 volts, resulting in more reliable electrical connections. Lamp lumen output and color consistency also are more uniform. Although discussed with reference to low voltage applications, the concepts described herein for track light systems can be applied to other operating voltages as well, such as, for example, 124 volts or higher.

The track lamp fixtures and holders are miniaturized to perform their lighting tasks with a low profile system. Low-voltage halogen light can be used for dramatic emphasis while protecting against fading and light damage. Lamp holders also are designed with a reduced number of parts to reduce manufacturing costs.

The details of one or more implementations are set forth in the accompanying drawings and the description below. Other features and advantages will be apparent from the description, the drawings, and the claims.

DESCRIPTION OF DRAWINGS

FIGS. 34-37 are perspective views of front and rear housings for the rotation lock light fixture.

Like reference symbols in the various drawings indicate like elements.

DETAILED DESCRIPTION

Figure 1:
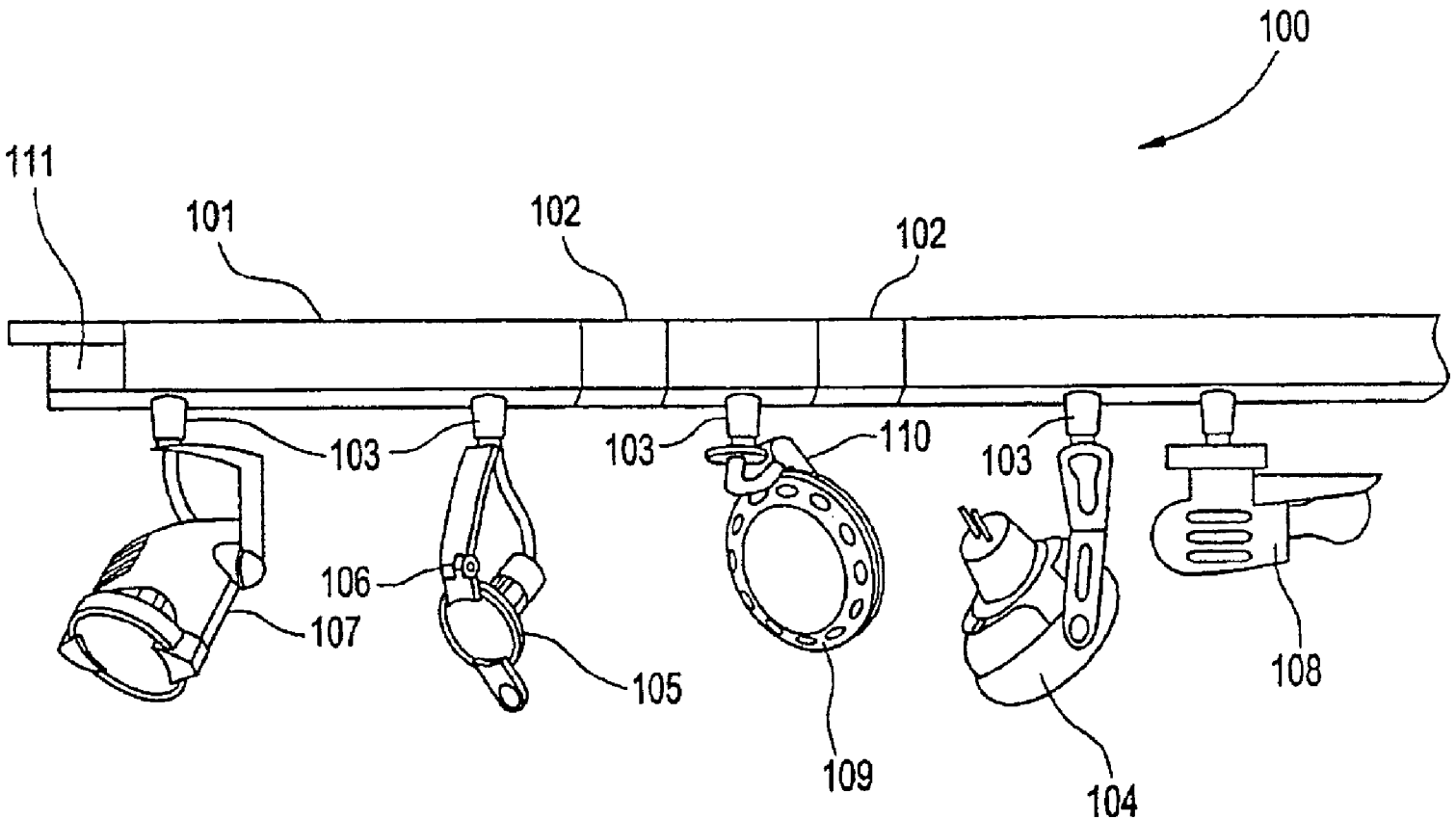
FIG. 1 is a perspective view of a track light system.

Referring to FIG. 1, a track light system 100 includes a track network 101, a connector 102, interfaces 103, a lamp holder 104 with a constant tension lamp arm with integral rotation stop, a lamp holder 105 with a pivot mechanism 106, a lamp holder 107 with integral lens retention spring, a wedge-base lamp holder 108, a rotation lock light fixture 109 with a pivot mechanism 110, and a feed 111.

The track light system 100 may be operated at various voltages. For example, the track light system may be operated at 24 volts and 25 amps (600 watts) or at 12 volts and 25 amps (300 watts). Operating at these voltages, the track light system 100 does not require grounding. The track light system 100 may be operated with a variety of power supplies. For example, the track light system 100 may be operated with 60, 150, or 300 watt electronic power supplies, or with 150, 300, 600, or 1200 watt magnetic power supplies. Power supplies may be designed for operation at various input voltages, such as, for example, 120 volts or 277 volts, with alternating current feed.

Electronic power supplies are lightweight and relatively small, allowing their use in cabinets and confined areas. Power supplies are designed for tie-in to existing feed locations and can be placed at the start of the track network 101 or at any point along the track network 101.

Magnetic power supplies, though larger and heavier, can handle larger loads. These power supplies are available for 120 volt or 277 volt feeds. The wiring used to connect the magnetic power supply to the track network 101 can affect the load carrying capability of the track light system 100. Boost taps can be used to increase the rated power capability of the track light system 100.

Figure 2A:
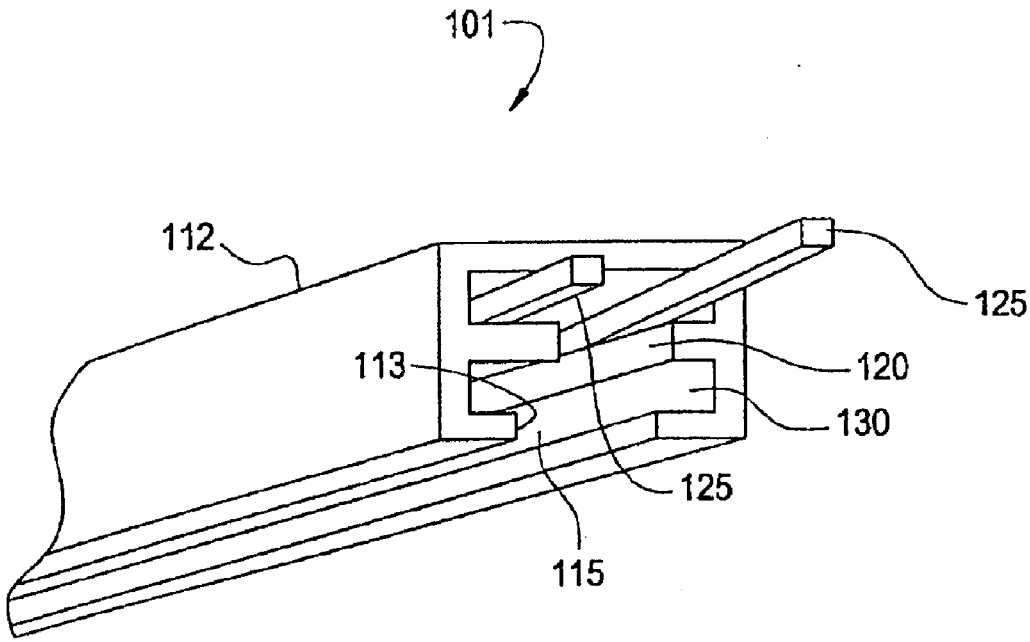
FIG. 2A is a perspective view of a surface channel track network of the track light system of FIG. 1.

Referring also to FIG. 2A, the track network 101 includes a track frame 112 with an opening 113, a lower channel 115, and an upper channel 120. The upper channel 120 includes a pair of conductors 125. An open slot 130 extends from the lower channel 115 into the upper channel 120. The interface 103 (described below with respect to FIG. 9) is designed for insertion through the opening 113 with portions of the interface 103 secured in the lower channel 115 and the upper channel 120 so as to make an electrical connection with the conductors 125 within the track network 101.

The track network 101 comes in various lengths. For example, the track network 101 may come in 2, 4, 6, or 8 foot lengths. Track networks 101 also may be cut to any particular length. Track networks 101 may have different finishes, such as, for example, white, black or silver-metallic finishes.

In the implementation of FIG. 2A, the track network 101 is configured to be a surface channel track network with minimal size and weight. For example, the surface channel track network may be ⅜ inches high and ¾ inches wide. The surface channel track network may be made from thermoplastic materials. The flexibility of these materials allows the track network 101 to be bent to conform to a non-linear surface. Typical applications for such a track network 101 are under-cabinet, in-cabinet, cove, and strip lighting.

Figure 2B:
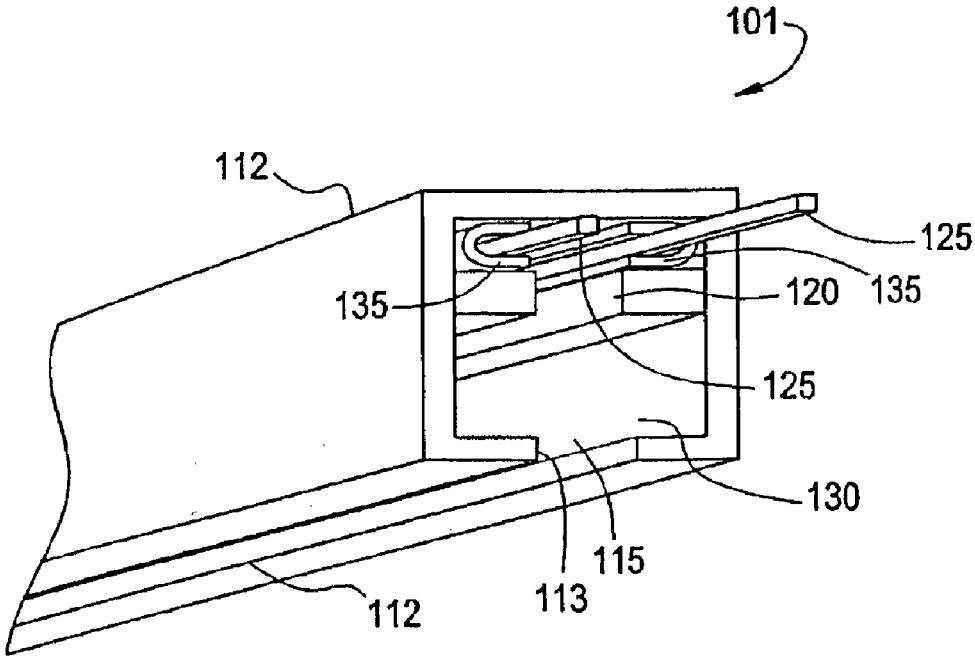
FIG. 2B is a perspective view of a wire way channel track network of the track light system of FIG. 1.

In another implementation, illustrated in FIG. 2B, the track network 101 is configured to be a wire way track network with more size and weight. For example, the wire way channel track network may be one inch high and one inch wide. The wire way channel track network may be made from materials with additional strength, such as, for example, extruded aluminum. Typical applications for this type of track network 101 are where additional mechanical strength is desired, such as, for example, suspended applications and accent or display lighting. Wire way track networks may be mounted directly to a surface or suspended. The wire way track networks also differ from the surface channel track networks because of the relatively larger size of the lower channel 115 of the wire way track network, which is sized to accommodate conductors 125 or wires to provide power to another part of the track light system.

The wire way track network accommodates conductors 125 that are insulated from the metal track frame 112 by insulation 135. Stranded wire, as well as conductors, also may be housed in the track frame 112.

The conductors 125 are made of conductive metal materials, such as, for example, copper, nickel-plated copper, or nickel-plated brass. The conductors 125 may have various sizes, such as, for example, 10, 12, or 14 AWG.

Figure 3:
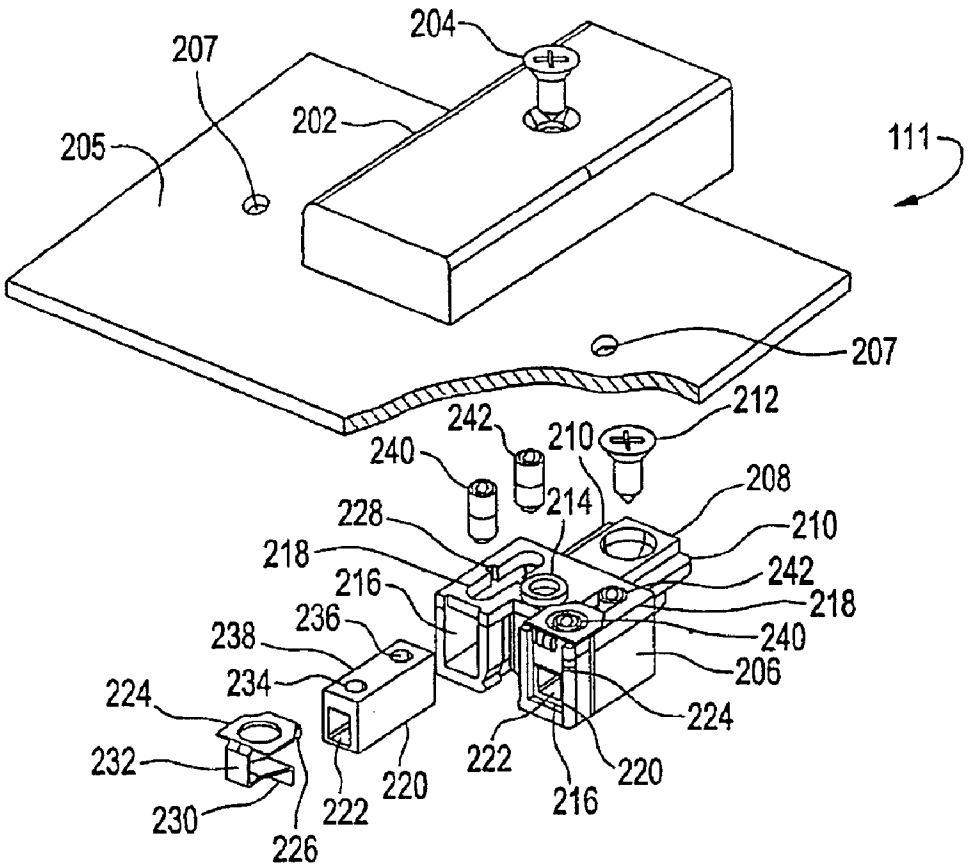
FIG. 3 is an exploded perspective view of a track connector for use with the track network of FIG. 2.

Referring to FIG. 3, the feed 111 includes a housing 202, a housing screw 204, a mounting portion 205, and a body 206. The mounting portion 205 is used to mount the housing 202 to a ceiling or a wall and includes channels 207 for inserting a screw or nail. The body 206 includes a mating wing 208 with lips 210, a mating screw 212, a housing screw hole 214, channels 216, and slots 218.

Contact blocks 220 are positioned in the channels 216, which extend through the body 206. Each contact block 220 includes an opening 222 that extends through the contact block 220 in the same direction as the channel 216.

The contact blocks 220 (FIG. 3) and 262 (FIG. 5) may be made of materials such as are described in FIG. 2 above with respect to track conductors 125. A contact retainer 224 partially wraps around the body 206 with a head 226 of the contact retainer 224 inserted into a notch 228 in the slot 218 and a foot 230 of the contact retainer 224 inserted inside the opening 222 of the contact block 220. The foot 230 on the contact retainer 224 is configured to act as a stop for track conductors 125 that are inserted into the opening 222.

The contact block 220 has a threaded rear hole 234 and a threaded front hole 236 through a top surface 238 of the contact block 220. A rear retaining screw 240 and a front retaining screw 242 are configured to be threadably inserted into the threaded holes 234, 236 and into the openings 222. The rear retaining screw 240 is threaded into the threaded opening through the slot 218 to fix the foot 230 of the contact retainer to the contact block 220. The head of the retaining screw 240 contacts an edge of the slot 218 to fix the contact block 220 inside the channel 216.

To electrically connect electrical wiring from, for example, a junction box or transformer, and a track network 101 to the feed 111, the rear retaining screw 240 is loosened and one wire of the electrical wiring is inserted into the opening 222 until the wire rests against the contact retainer 224. The rear retaining screw 240 then is tightened down into the opening 222 to hold that wire in place in the contact block 220. The other wire from the electrical wiring is inserted into the other contact block 220 from the same direction and retained in the contact block 220 in the same manner. Then, one conductor 125 from one track network 101 is inserted into the opening 222 from the other direction until the conductor rests against the contact retainer 224. The front retaining screw 242 then is tightened down into the opening 222 to hold that conductor 125 in place in the contact block 220. The other conductor 125 from the track network 101 is inserted into the other contact block 220 and retained in the contact block 220 in the same manner. The housing or cover 202 then may be mounted over the body 206.

Figure 4:
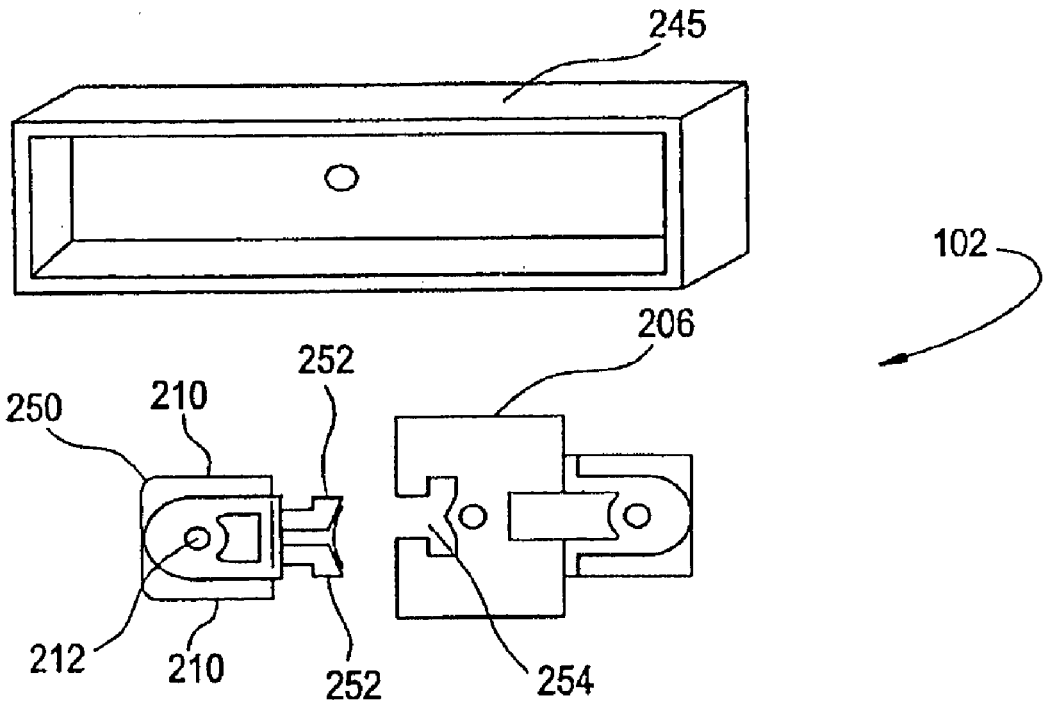
FIG. 4 is a bottom view of a mating wing usable with the track connector of FIG. 3.

Referring to FIG. 4, the connector 102 has many of the features of the feed 111 and also may include a housing 245 and a removable mating wing 250 with features similar to those of the mating wing 208, including lips 210 and a mating screw 212. The removable mating wing 250 is slidably connected to the body 206 by flared insert tabs 252 that mate with a recess 254 in the body 206. Because the removable mating wing 250 is oriented in the opposite direction as the other wing of the body 206, track network 101 can be mounted to both sides of the connector 102 to connect to track networks and extend the track light system 100. The conductors 125 of each track network 101 are inserted into the openings 222 of the contact block 220 in the same manner described above with respect to FIG. 3.

Figure 5:
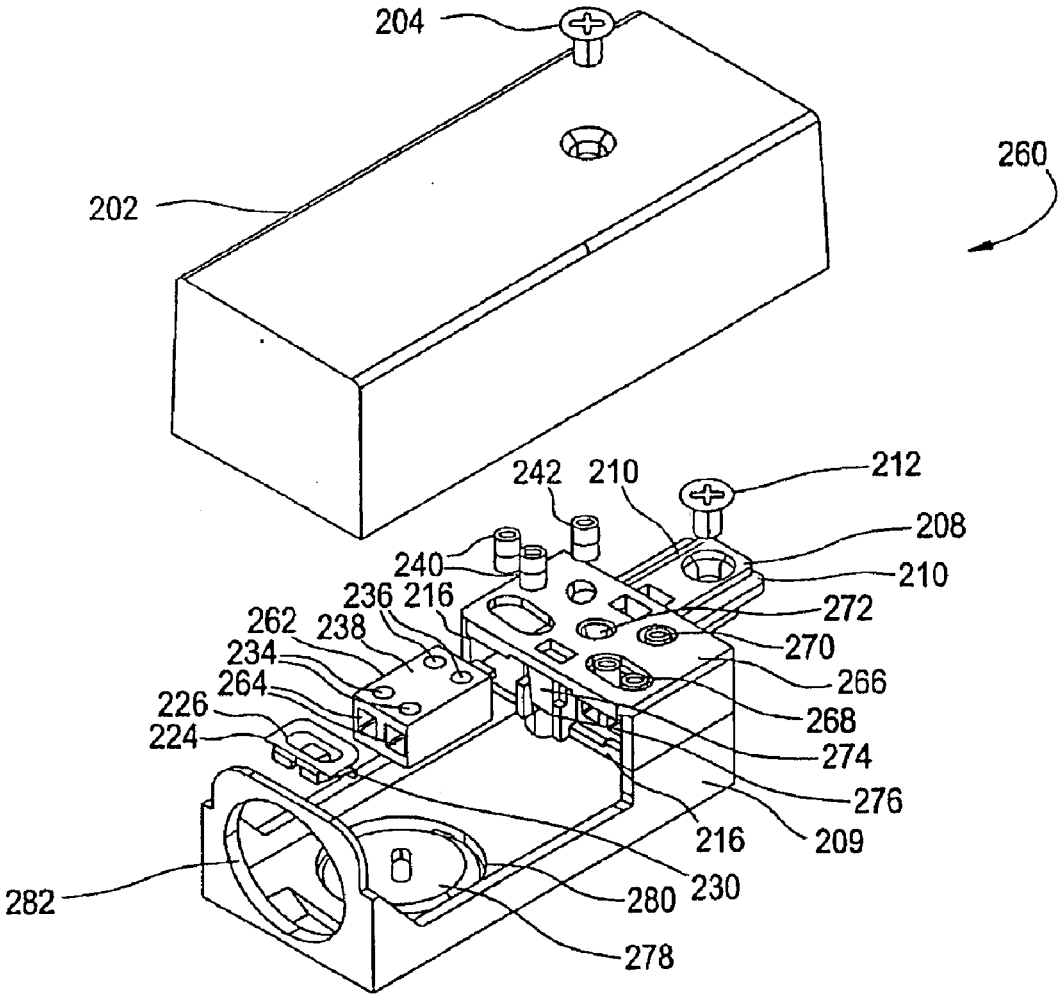
FIG. 5 is an exploded perspective view of a second track connector usable with the track light system of FIG. 1.

Referring to FIG. 5, an end-feed, dual connector 260 holds a pair of dual opening contact blocks 262. Each contact block 262 includes a pair of dual openings 264. The end-feed dual connector 260 has features similar to those of the feed connector 102 described with reference to FIG. 3, including a housing 202, a housing screw 204, and a body 209. The body 209 includes a tongue 208 with wings 210 and a tongue screw 212. The body 209 also includes a housing screw hole 272 and channels 216.

The contact blocks 262 are configured to be inserted in the channels 216. In this implementation, however, the channels 216 are open at the top and are covered by a plate 266. The plate 266 has rear screw holes 268, front screw holes 270, and the housing screw hole 272. As in the feed connector 102, the contact blocks 262 have openings 264 extending through the contact blocks 262 in the same direction as the channels 216. The contact blocks 262 have dual threaded rear holes 234 and threaded front holes 236 extending from the top surface 238 into the openings 264.

Rear retaining screws 240 extend through the rear screw holes 268, into the rear holes 234, and into the openings 264. Similarly, the front retaining screws 242 extend through the front screw holes 270, into the front holes 236, and into the openings 264. The plate 266 is positioned over the body 209 and retained by clamp arms 274 that extend from the plate 266 into notches 276 in the body 209.

The body 209 also includes a knock-out 278. The knock-out 278 is removed to provide a knock-out hole 280 for electrical wiring (not shown). An aperture 282 in the body 209 also can be used for electrical wiring (not shown). The wiring then is inserted into the openings 264 and the rear screws 240 are tightened down to fix the wiring to the contact block 262.

Figure 6:
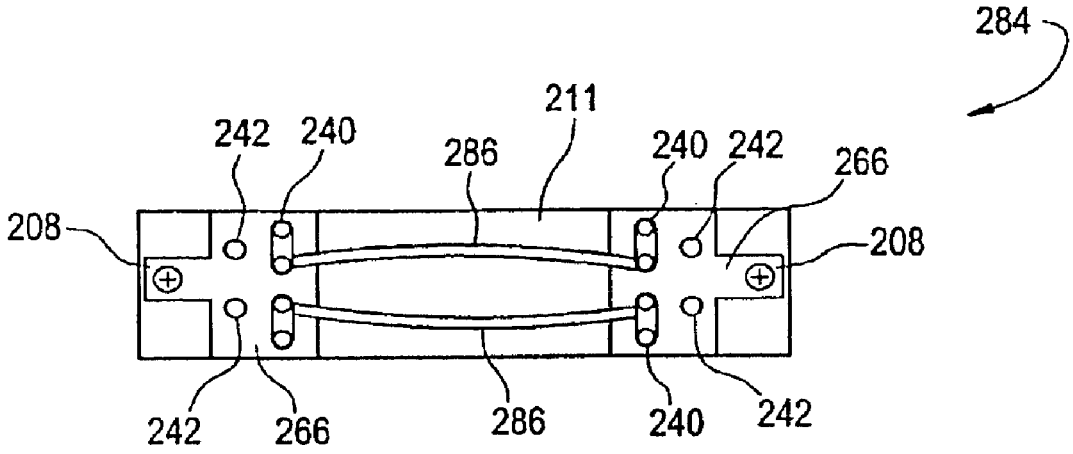
FIG. 6 is a bottom view of a straight track connector usable with the surface channel track network of FIG. 2A.

A variety of configurations for a feed connector may be employed. For example, the end-feed dual connector 260 as shown in FIG. 5 may be configured as a straight joiner connector for the wire way channel. Referring to FIG.6, a straight joiner connector 284 includes a body 211 with two sets of mating wings 208, channels 216 (shown in FIG. 3), contact blocks 220 (shown in FIG. 3), and plates 266. Front retaining screws 242 and rear retaining screws 240 engage electrical wires 286 and other electrical components inserted in the openings 264 in the contact blocks 262 (FIG. 5).

Figure 7:
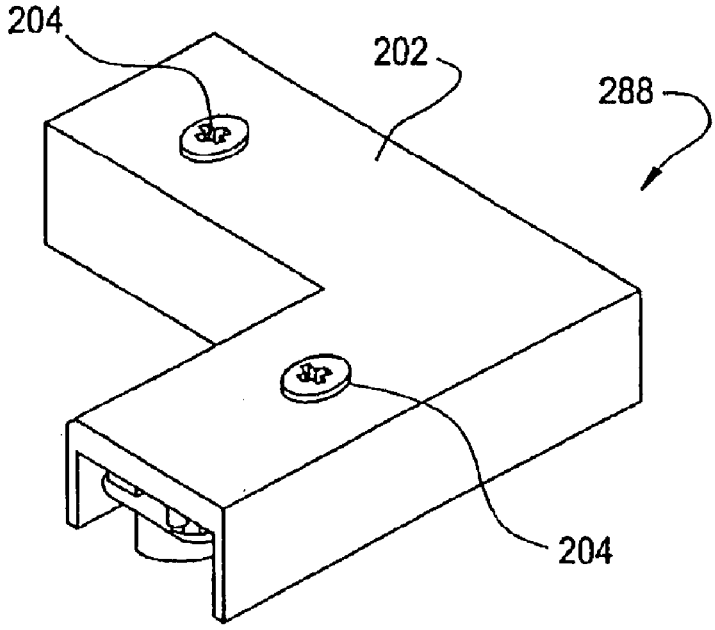
FIG. 7 is a perspective view of an angled track connector usable with the track network of FIGS. 2A and 2B.
Figure 8:
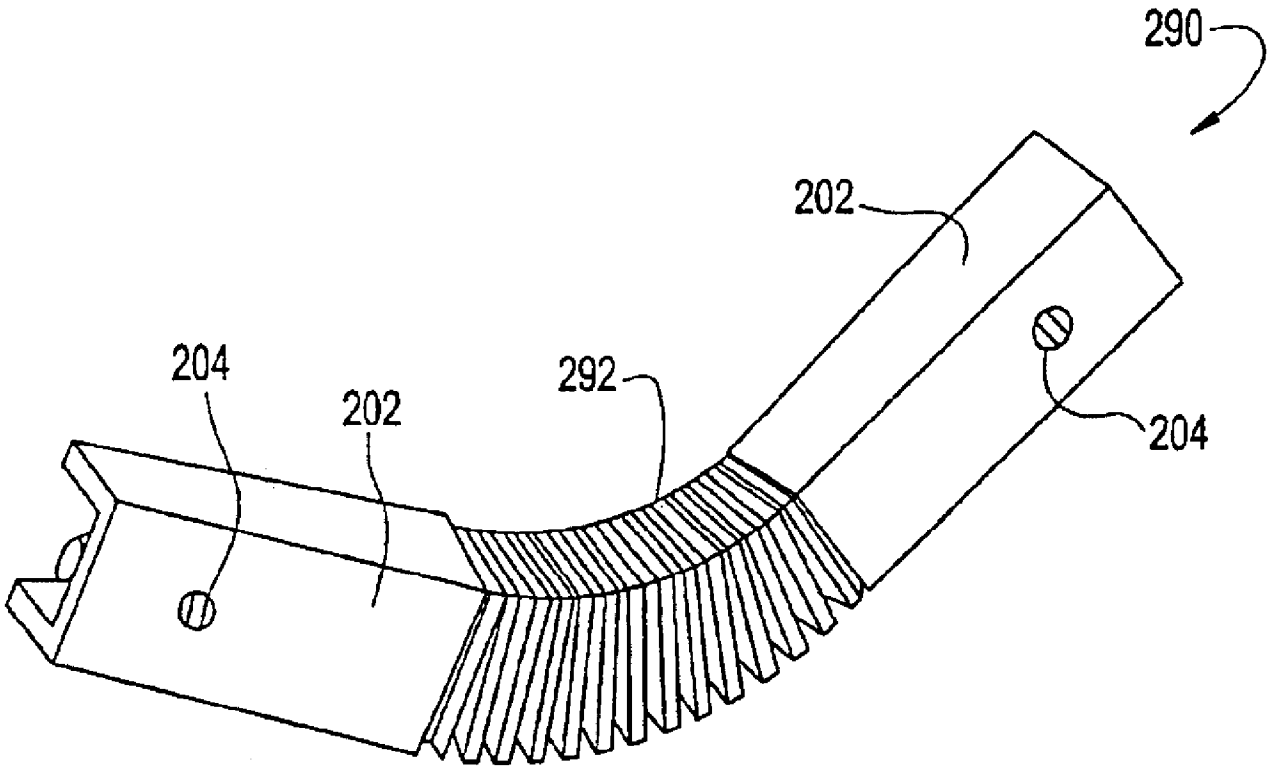
FIG. 8 is a perspective view of a flexible track connector usable with the track network of FIGS. 2A and 2B.

Referring to FIG. 7, in another configuration, the feed connector is configured as a right-angle joiner connector 288. Referring to FIG. 8 the feed connector also can be configured as a flexible feed connector 290 that includes a flexible mid-section 292. The connectors 288 and 290 have features of the connectors 102, 245, and 260 such that electrical wires can be connected to the connectors 288, 290. Other implementations of connectors include J-box feed connectors for use in mounting to a single gang wall or ceiling-mount junction box, end-feed connectors for starting a run, and T-bar and J-box canopy feed connectors for starting a run on a T-bar ceiling installation.

Figure 9:
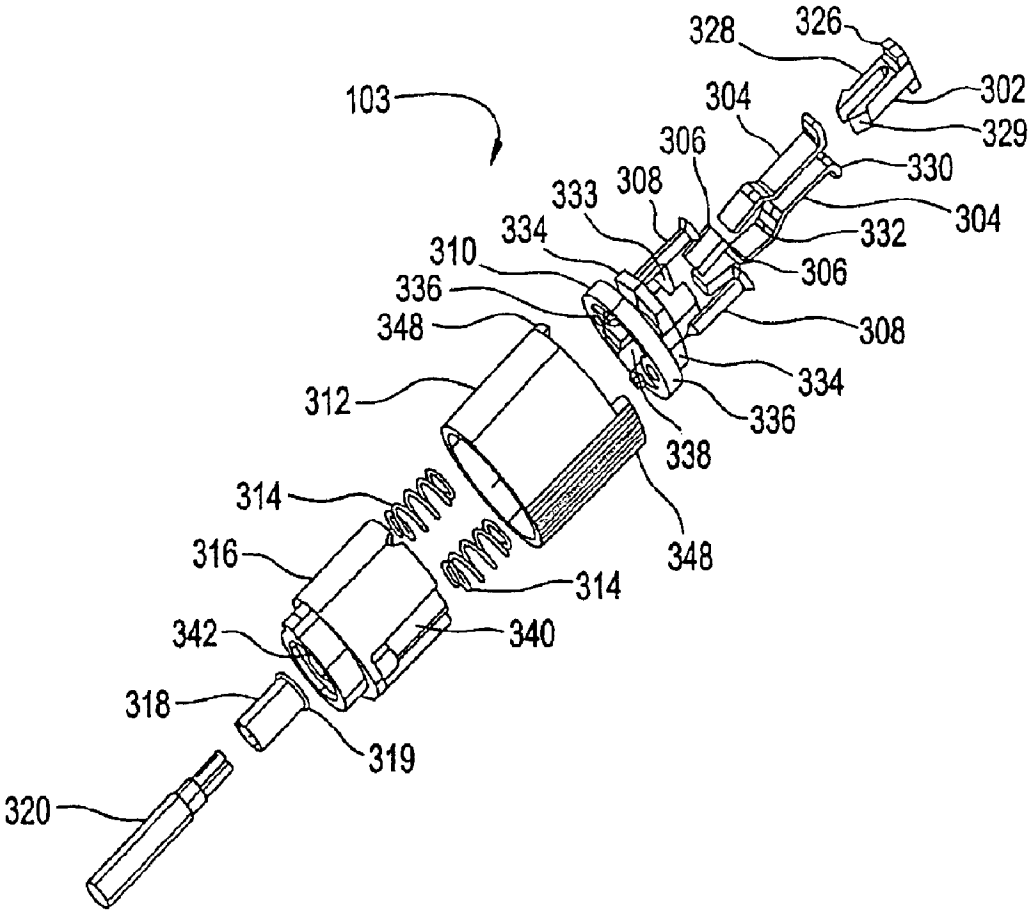
FIGS. 9 and 10 are exploded perspective views of an interface for use with the track light system of FIG. 1.
Figure 10:
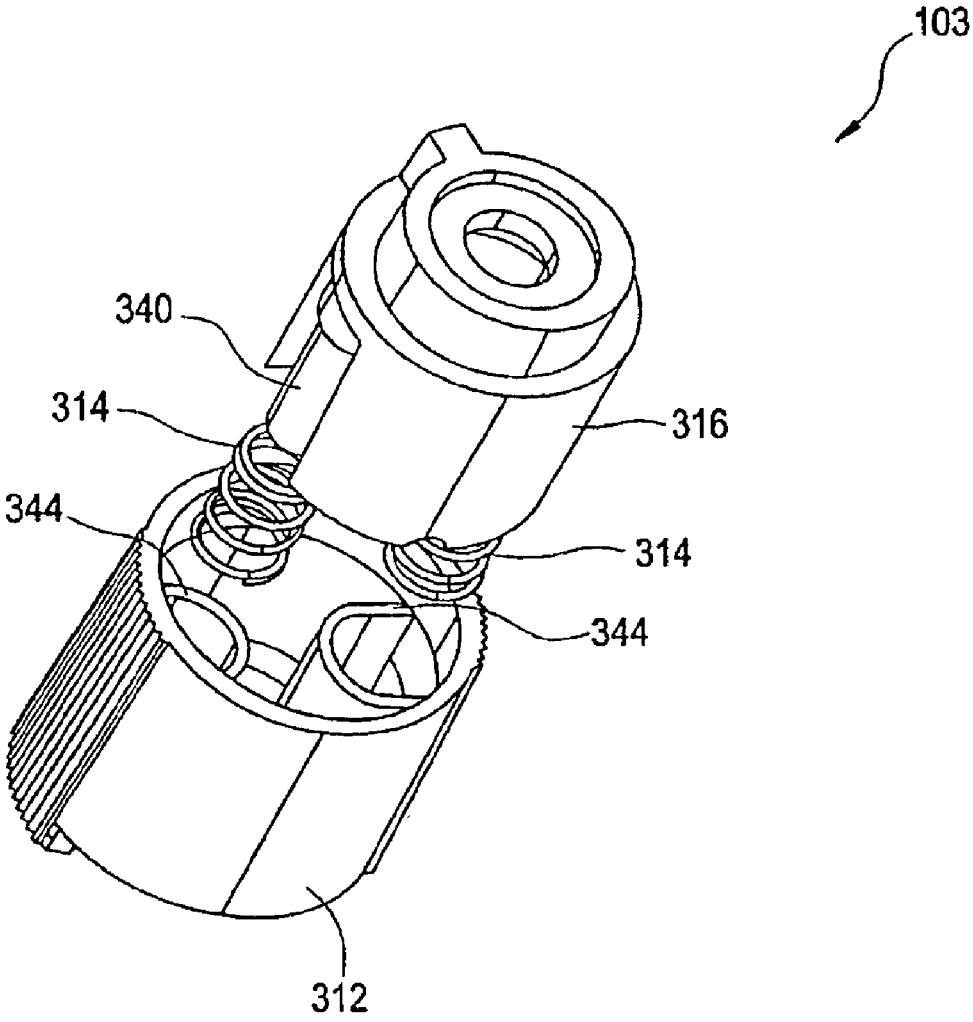

Referring to FIG. 9, a track fixture interface 103 includes a cap 302, contact clips 304, jackets 306, screws 308, a top 310, a housing 312, a pair of springs 314, a base 316, a collar 318 with a lip 319, and an electrical wire 320. The screws 308 and the springs 314 are isolated from the contact clips 304 by plastic cylindrical walls 344 that are molded in place (FIG. 10). The cap 302 includes a head 326 and two arms 328 that terminate in flared hooks 329. The cap 302 is retained in place by a one-way latching mechanism that provides advantages over other retention means, such as a screw or a rivet, because the cap is easily inserted in place and does not require additional components. Each contact clip 304 includes a contact head 330 and a foot 332. The top 310 includes a notch 333, insert wings 334, a pair of screw holes 336, and a channel 338. The base 316 includes posts 340 and an aperture 342.

Referring also to FIG. 10, the springs 314 fit over the posts 340 on the base 316 and inside the pair of molded cylinders 344 in the housing 312. In this manner, the base 316 is slidable within the housing 312, with the spring 314 resisting insertion of the base 316 within the housing 312. The stiffness of the springs 314 can be adjusted to vary the resistance caused by the springs.

Figure 11:
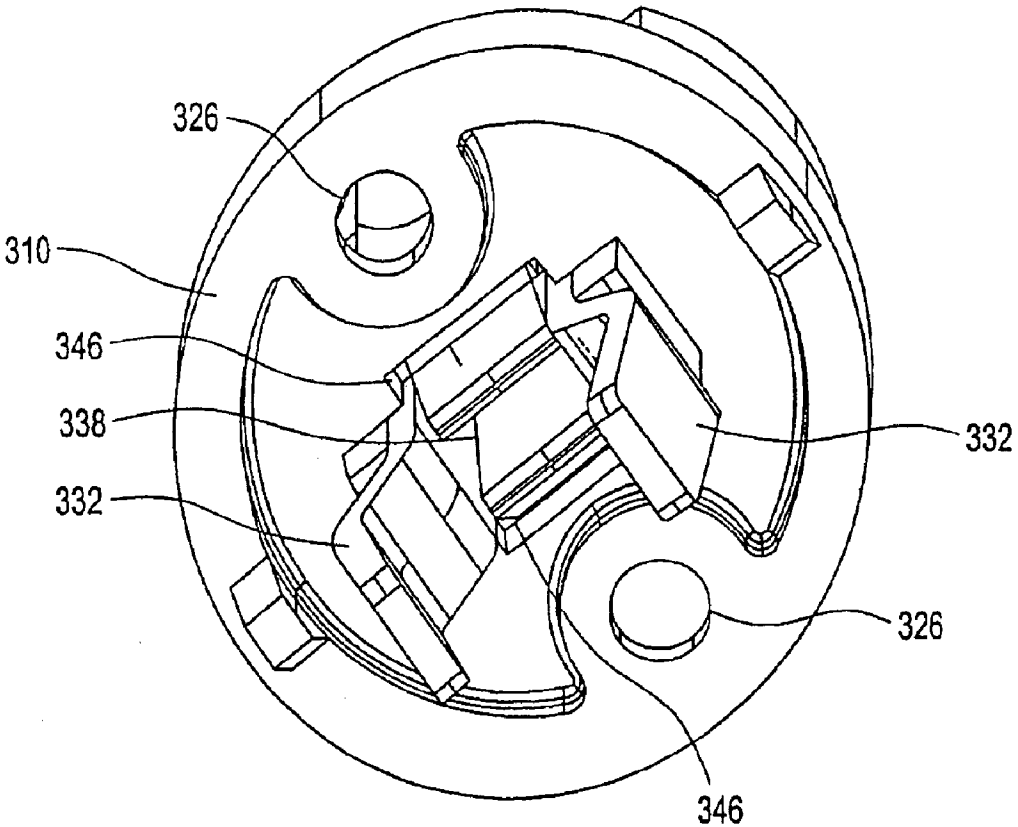
FIG. 11 is a bottom perspective view of the interface of FIGS. 9 and 10.

Referring also to FIG. 11, the foot 332 of each contact clip 304 is inserted through the channel 338. The arms 328 of the cap 302 then are inserted into the channel 338 until the head 326 is flush with the notch 333 above the insert wings 334. In this position, the hooks 329 extend through the channel 338 and expand outward into ledges 346 at the end of the channel 338, to lock the cap 302 in place.

Referring again to FIG. 9, the collar 318 is placed inside the base 316 with the lip 319 directed upward toward the cap 302. The collar 318 is allowed to slide through the aperture 342 in the base 316 until the lip 319 contacts the inside surface of the base 316 surrounding the aperture. The electrical wire 320 is inserted through the collar 318 and extends through the aperture 342 in the base 316 and housing 312. Conductors in the electrical wire 320 then are spliced and connected to the feet 332 of the contact clips 304 by placing each jacket 306 over the conductor and the foot 332 of the contact clip 304, and tightly crimping the jacket 306.

The interface 103 provides an electrical and mechanical connection between the track network 101 and a track light fixture. Installing the interface 103 into the track network 101 includes inserting the interface 103 into the opening 113 with the insert wings 334 extending through the slot 130 of the track frame 112 with the contact head 330 of the contact clip 304 in the lower channel 120 and the insert wings 334 in the upper channel 115. The interface 103 is rotated approximately 90 degrees relative to the track frame 110, which tightly wedges the insert wings 334 into the upper channel 115 and causes the contact head 330 of the contact clip 304 to make an electrical connection with the track network conductor 125. The springs 314 force the housing 312 against the track network 101 with tabs or rotation stops 348 on the housing 312 inserted into the opening 113 in the track frame 110. The insert wing 334 and rotation stops 348 prevent accidental separation or dislodgment of the interface 103 from the track network. The interface 103 provides advantages, such as being configured from fewer parts than conventional connectors or interfaces. Moreover, the interface 103 is advantageously smaller than conventional connectors or interfaces.

Figure 12:
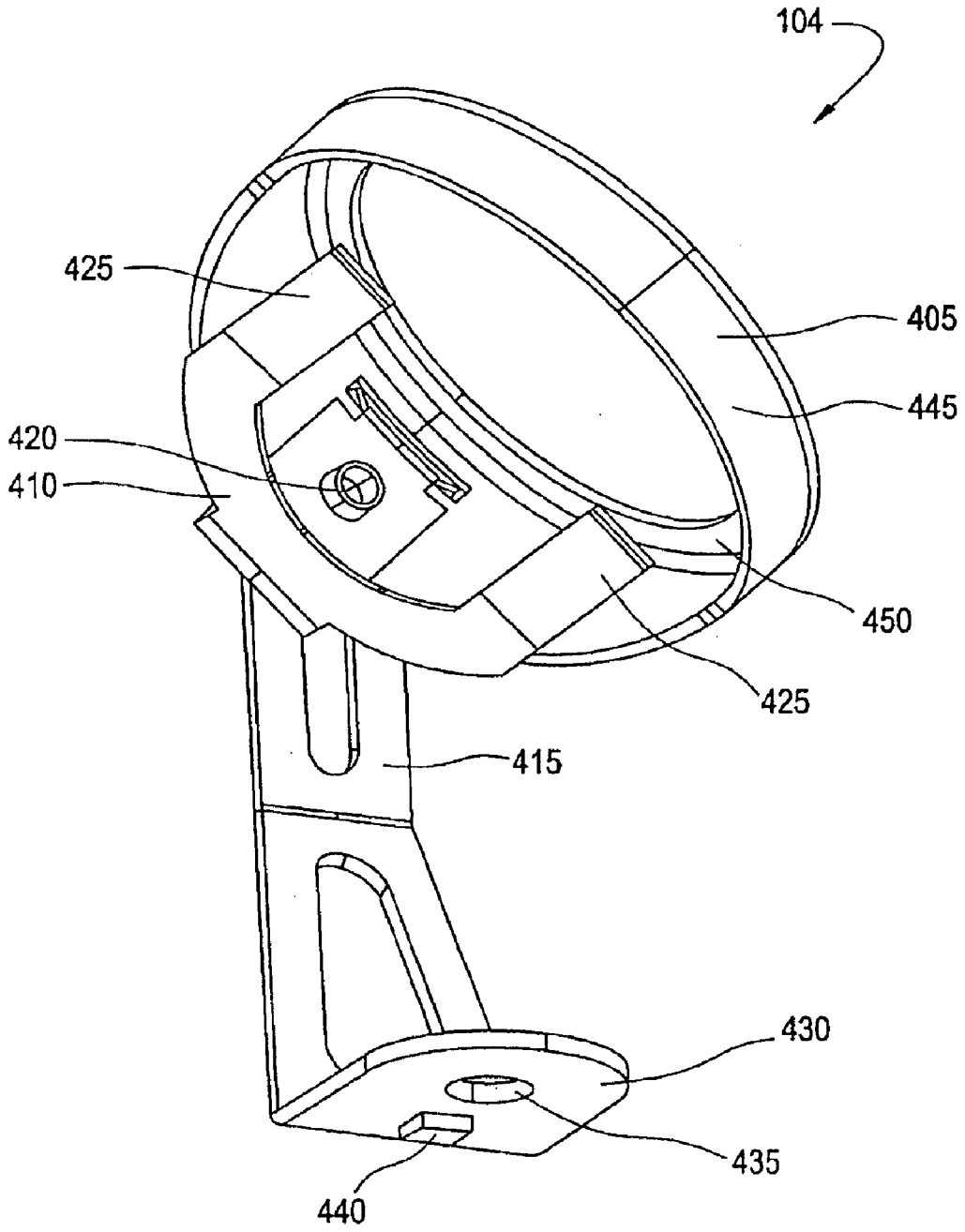
FIGS. 12 and 13 are perspective views of a constant tension and rotation stop lamp holder.
Figure 13:
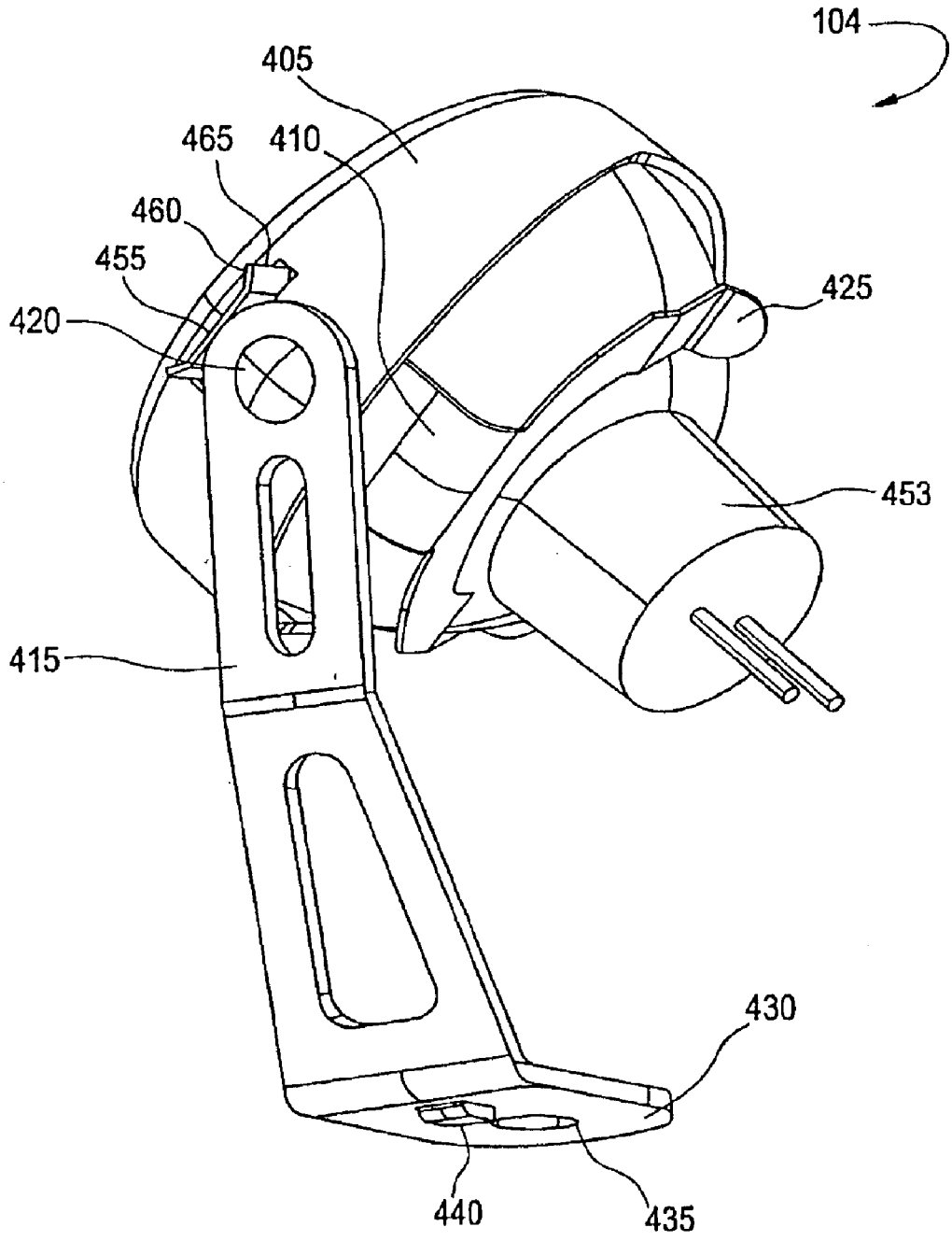

Referring to FIGS. 12 and 13, a constant tension and rotation stop light fixture 104 includes a lamp retaining ring 405, a lamp retaining arm 410, and an aiming arm 415. The lamp retaining arm 410 is attached to the aiming arm 415 with a rivet 420 and includes a pair of resilient fingers 425. The aiming arm 415 includes a base 430 that includes an opening 435 and a stop 440. The lamp retaining ring 405 includes a body 445 that has a perpendicularly directed lip 450.

FIG. 13 shows a light bulb 453 installed in the adjustable lamp arm 104 of FIG. 12. The light bulb 453 is positioned between the lip 450 and the fingers 425, with the front of the light bulb facing the lip 450. The pair of resilient fingers 425 exert pressure against the light bulb 453 to hold it against the lip 450.

The opposing end of the lamp retaining arm 410 includes a foot 455 with sloped sides 460. The foot 455 extends through a slot 465 in the lamp retaining ring 405. As the lamp retaining ring 405 and lamp retaining arm 410 are rotated in a circle around the axis of the rivet 420, the sloped sides 460 of the foot 455 come into contact with the aiming arm 415, which blocks further rotational motion in the same direction. Thus, the foot 455 acts as a rotation stop.

Figure 14:
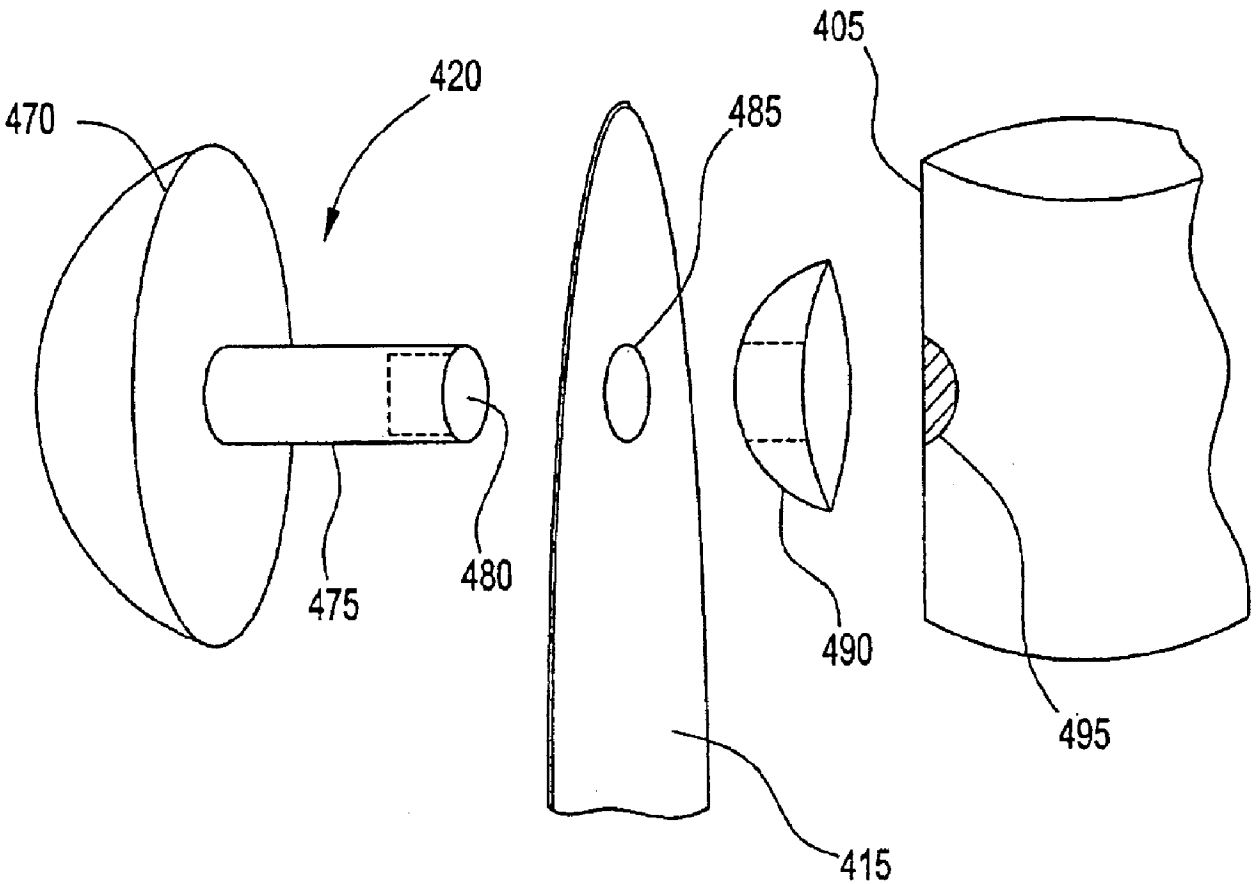
FIGS. 14 and 15 are side views of the constant tension and rotation stop of FIG. 12.

The lamp retaining ring 405 and the lamp retaining arm 410 are mounted to the aiming aim 415 using the rivet 420 around which the lamp retaining ring 405 and lamp retaining arm 410 can pivot. Referring also to FIG. 14, the rivet 420 includes a head 470, a shank 475, and a hollow 480. The shank 475 of the rivet 420 is inserted through a hole 485 in the aiming arm 415, an opening in a tension washer 490, and a hole 495 in the retaining ring 405.

Figure 15:
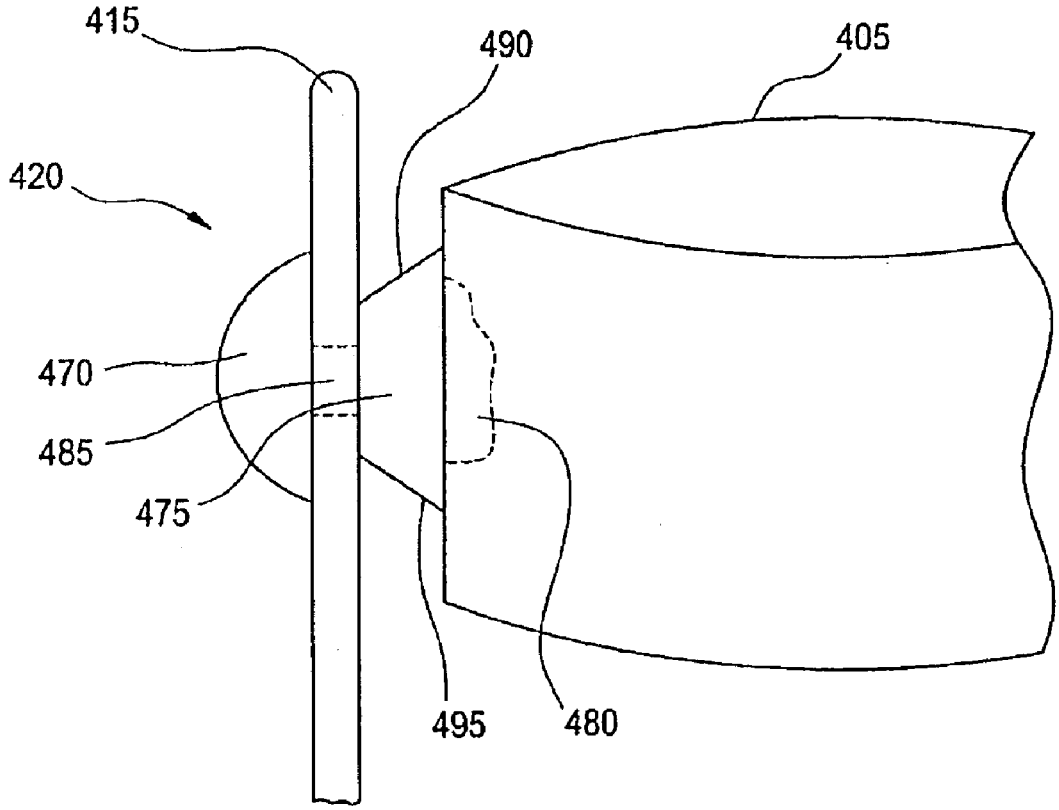

Referring also to FIG. 15, the rivet 420 is crimped to attach the aiming arm 415 to the lamp retaining arm 410, which causes the shank 475 in proximity to the hollow 480 to mushroom outward and flattens the shank 475 against the inside of the retaining ring 405. Crimping the rivet 420 also applies a compressive force to the tension washer 490 to reduce the cross sectional thickness, which leaves the washer 490 under a compressive force that the washer 490 resists by pressing outwardly against the aiming arm 415.

The aiming arm 415 may be rotated relative to the retaining ring 405 and will maintain a fixed position because of the tension that is exerted between the aiming arm 415 and the retaining ring 405 as the tension washer 490 attempts to expand to its normal shape. Thus, rotational motion and other uses that would otherwise cause laxity or space between the aiming arm 415 and the retaining ring 405 are avoided by the constant expansive force from the tension washer 490. In this manner, the tension washer 490 effectively allows the aiming arm 415 to be rotated to a desired, fixed position and to maintain that fixed position relative to the retaining ring 405.

Figure 16:
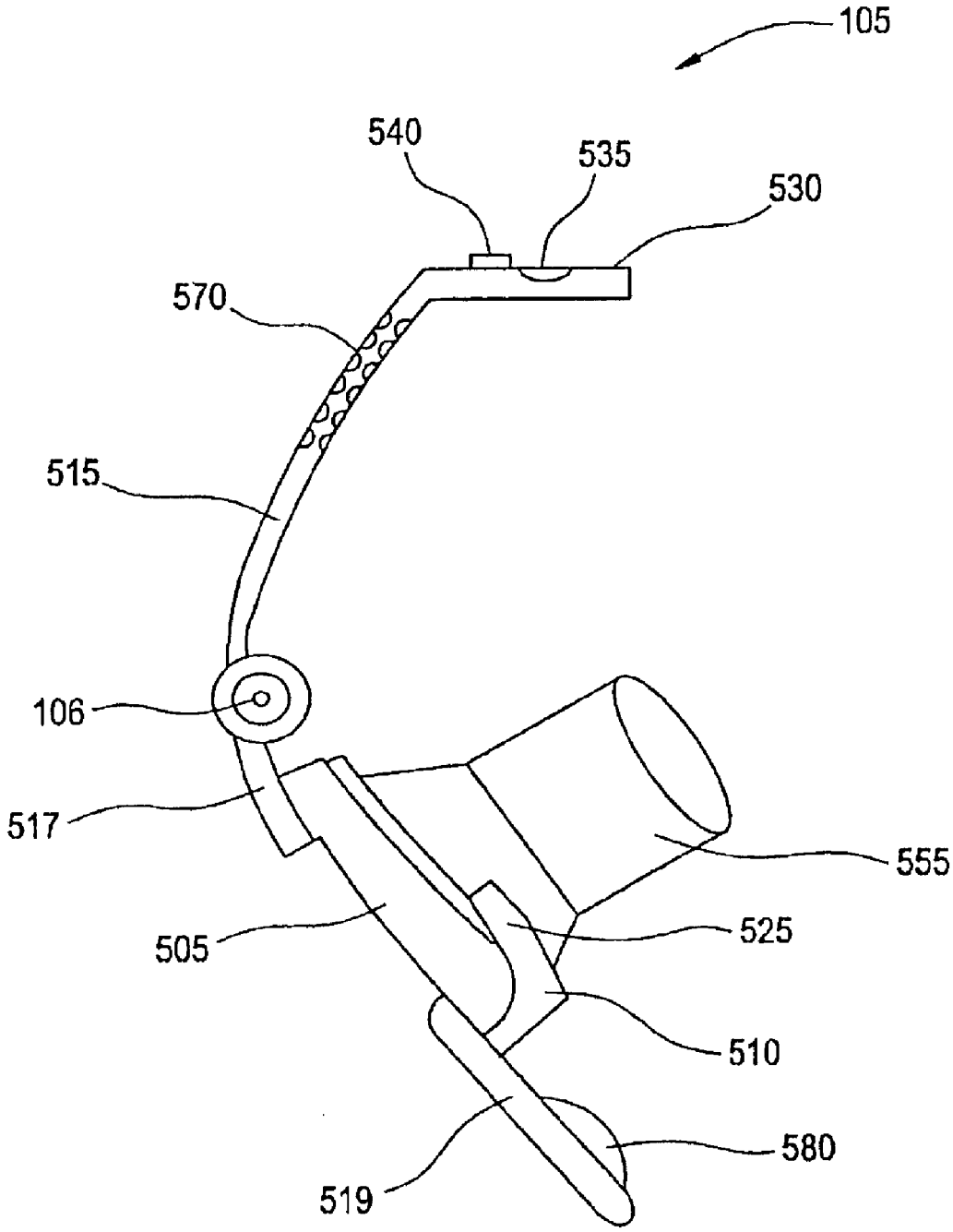
FIGS. 16 and 17 are side and perspective views of a lamp holder with a pivot mechanism.
Figure 17:
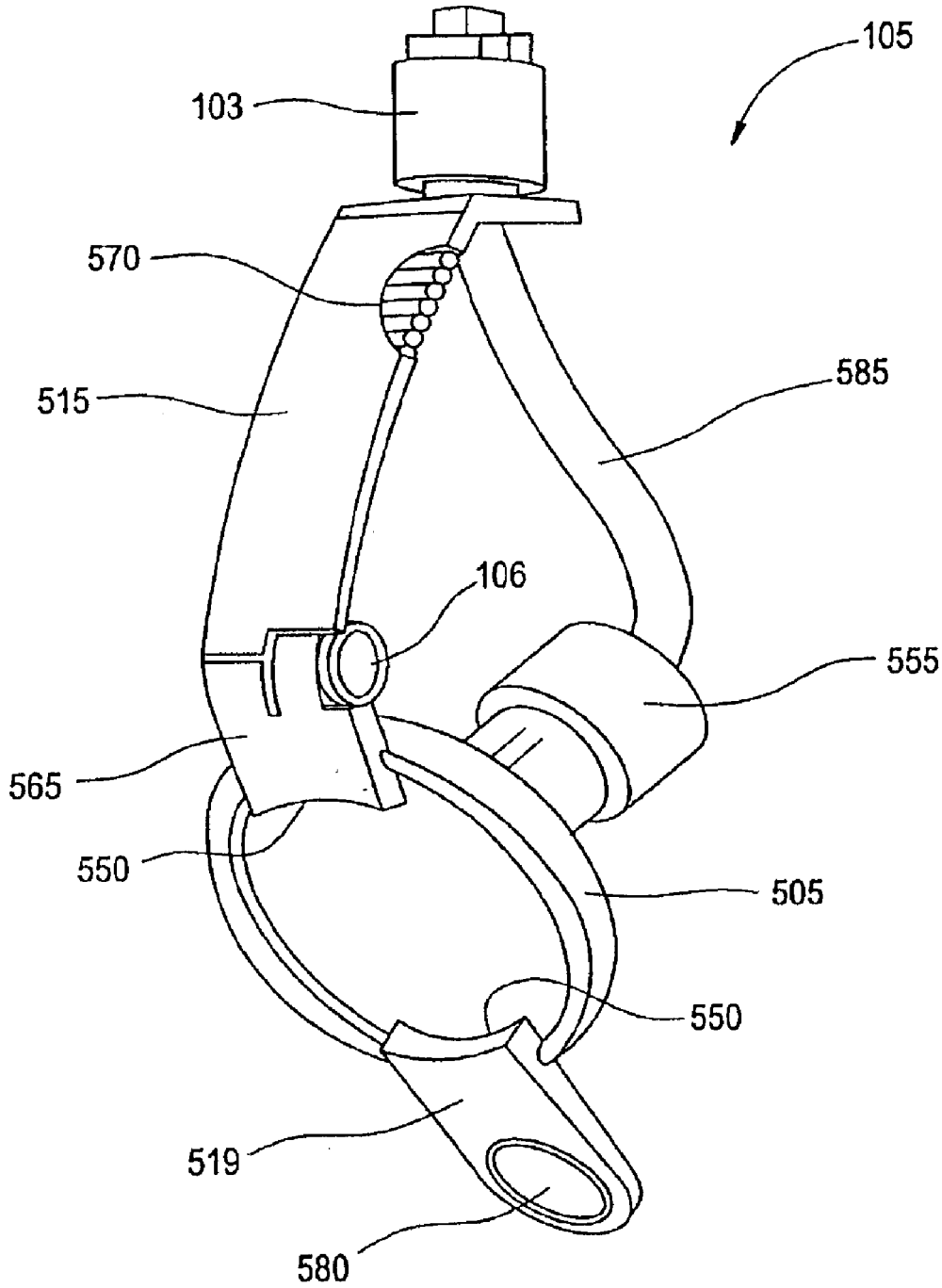

Referring to FIGS. 16 and 17, a lamp holder 105 with the pivot mechanism 106 includes a lamp retaining ring 505, a lamp retainer 510, an extension arm 515, a connecting arm 517, a positioning handle 519, and the pivot mechanism 106. The connecting arm 517 and the lamp retainer 510 are mounted to the lamp retaining ring 505. The lamp retainer 510 includes a pair of resilient fingers 525. The extension arm 515 includes a base 530 that has an opening 535 and a stop 540. The lamp retaining ring 505 has a perpendicularly directed lip 550 around part of the inner-circumference of the retaining ring 505.

The extension arm 515 has a ribbed area 570 and the positioning handle 519 has a grip dome 580. The grip dome 580 is made of rubber or other insulating material that does not easily conduct heat.

An electrical wire 585 connected to a light bulb 555 is inserted through the opening 535 and connected at the other end to the track fixture interface 103 described above with respect to FIGS. 9-11. With the track fixture interface 103, the lamp holder 105 can be moved along the track network 101 to provide illumination where desired.

Figure 18:
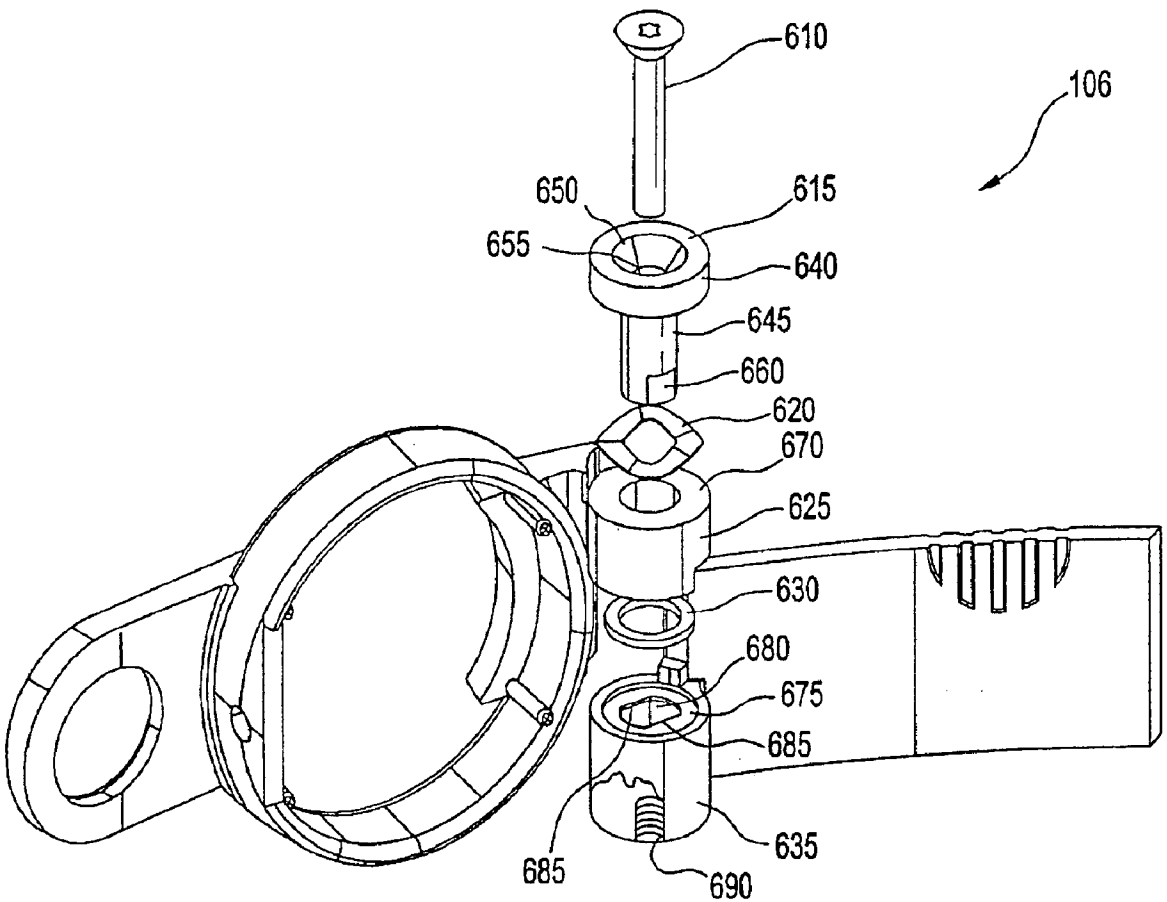
FIGS. 18-21 are exploded perspective views of pivot mechanisms.
Figure 19:
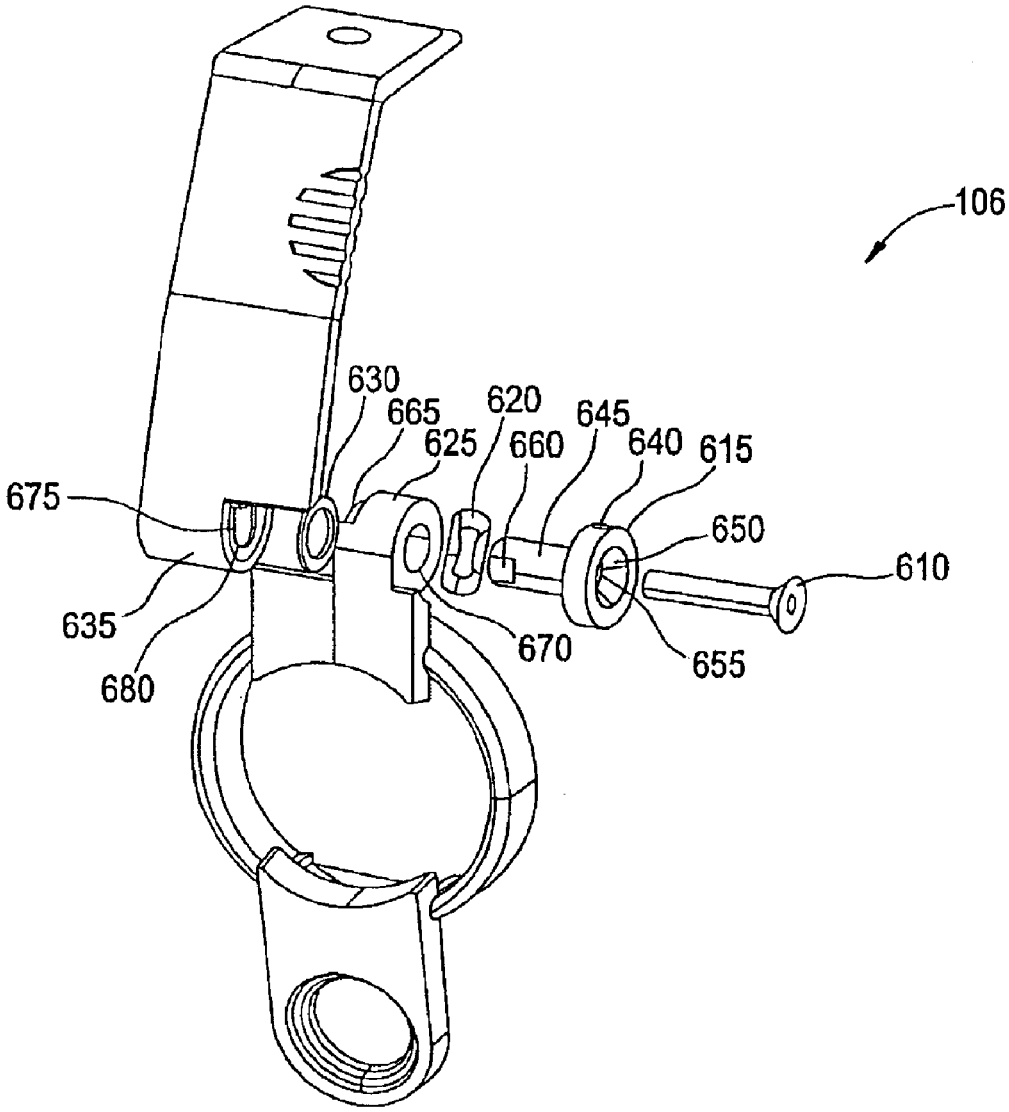

Referring to FIGS. 18 and 19, the pivot mechanism 106 includes a screw 610, a bushing 615, a compression washer 620, a pivot holder 625, a washer 630, and an arm pivot 635. The configuration of the pivot mechanism 106 is such that it prevents the screw 610 from backing out after repeated use. Thus, the pivot mechanism 106 also can be used in other applications that require a hinge with rotational motion that must not loosen over time and with repeated use.

The bushing 615 has a head 640 and a base 645. The head 640 has a bevel 650 and a hole 655 that pass through the center of the head 640 and continue through the base 645. The base 645 has two flat areas 660 at the end opposite the head 640. The pivot holder 625 includes a circular lip 665 (FIG. 19) with a smaller diameter than the outside surface of the pivot holder 625 extending around a portion of the pivot holder 625. A circular opening 670 extends through the pivot holder 625. The arm pivot 635 has a recess 675 that circles the inside diameter of the arm pivot 635 and a channel 680 extending about halfway into the arm pivot 635. The channel 680 is circular with two flat sides 685. The bottom of the channel 680 includes a threaded section 690 that extends deeper into the arm pivot 635 without penetrating the wall of the arm pivot 635.

The pivot mechanism 106 is assembled by placing the washer 630 into the recess 675 of the arm pivot 635. The pivot holder 625 then is placed against the arm pivot 635 such that the lip 665 extending from the pivot holder 625 fits within the inner diameter of the washer 630. The bushing 615 is inserted through the compression washer 620, into the opening 670 in the pivot holder 625, and then into the channel 680 in the arm pivot 635. In this position, the flat areas 660 on the bushing 615 mate with the flat sides 685 in the channel to prevent rotation of the bushing 615 with respect to the arm pivot 635. Next, the screw 610 is inserted into the hole 655 and is threaded into the threaded section 690 at the bottom of the channel 680 in the arm pivot 635 until the top of the screw 610 is flush with the top edge of the bevel 650. The arm pivot 635 is connected to the extension arm 515. The pivot holder 625 is connected to the connecting arm 517.

Figure 20:
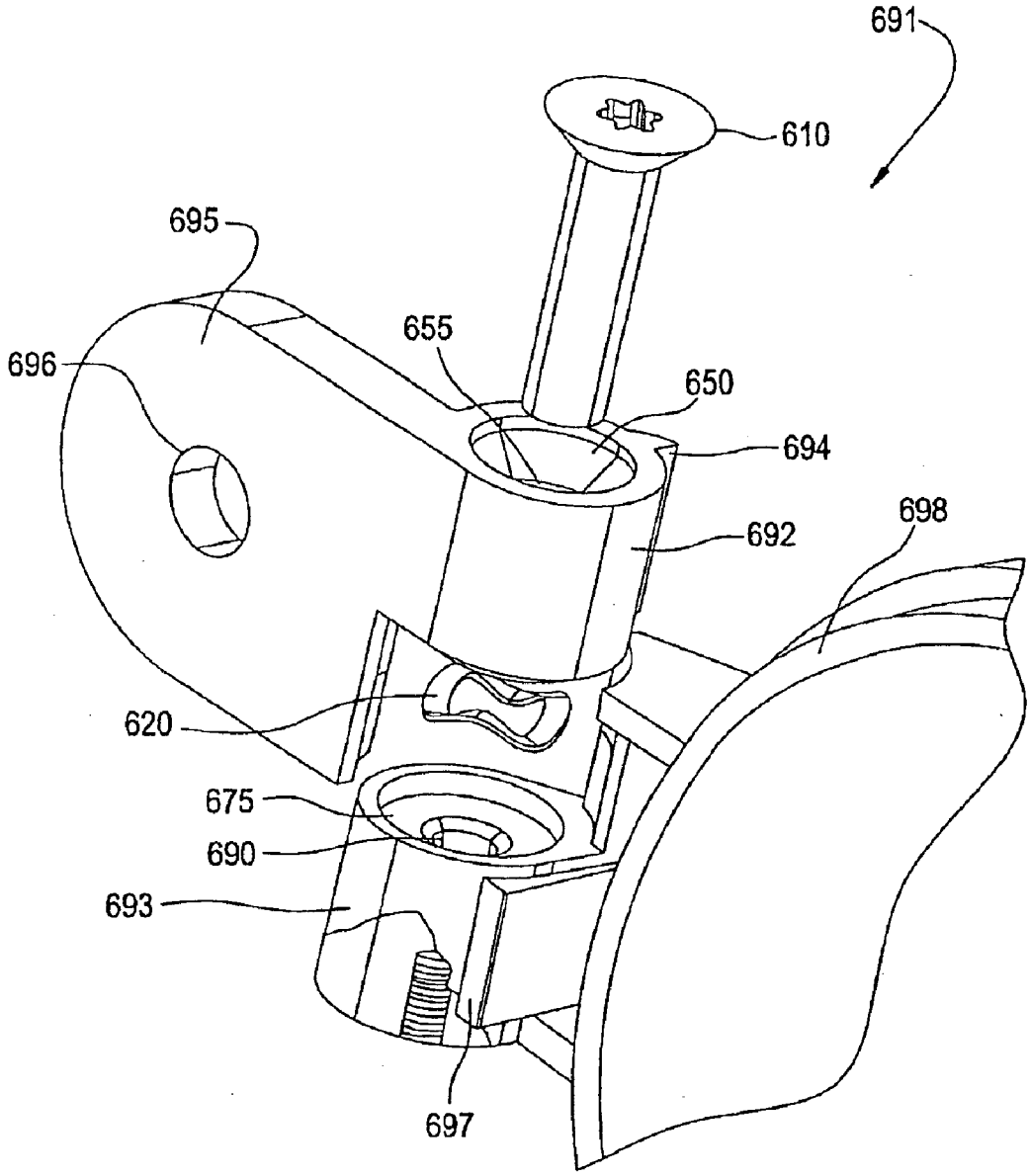
Figure 21:
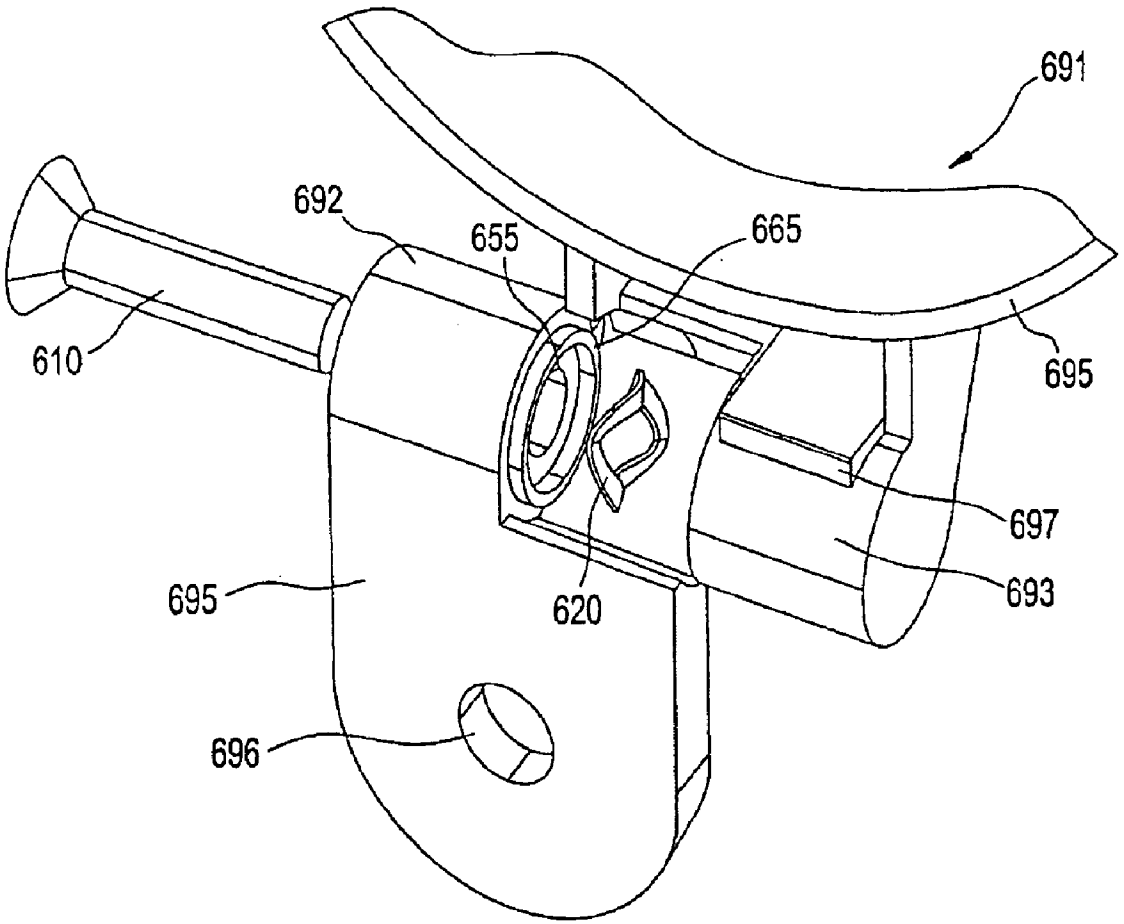

Referring to FIGS. 20 and 21, another implementation of a pivot mechanism 691 includes the screw 610, the compression washer 620, a base pivot 692, and a lamp pivot 693. The base pivot 692 includes the bevel 650, the hole 655 that extends through the base pivot 692, and a protruding rotation stop 694. The end of the base pivot 692 nearest to the lamp pivot 693 includes the circular lip 665 (FIG. 21) with a smaller diameter than the outside surface of the base pivot 692. The base pivot 692 is connected to a base plate 695 with a hole 696.

The lamp pivot 693 has a recess 675 (FIG. 20) that circles the inside diameter of the lamp pivot and a threaded section 690 extending into the lamp pivot. The lamp pivot 693 also includes a protruding rotation stop 697. The lamp pivot 693 is connected to a lamp housing 698.

The pivot mechanism 691 is assembled by placing the compression washer 620 into the recess 675 of the lamp pivot 693. The base pivot 692 then is placed against the lamp pivot 693 such that the lip 665 extending from the base pivot 692 fits within the recess 675. Next, the screw 610 is inserted through the hole 655 and is threaded into the threaded section 690 in the lamp pivot 693 until the top of the screw 610 is flush with the top edge of the bevel 650.

Figure 22:
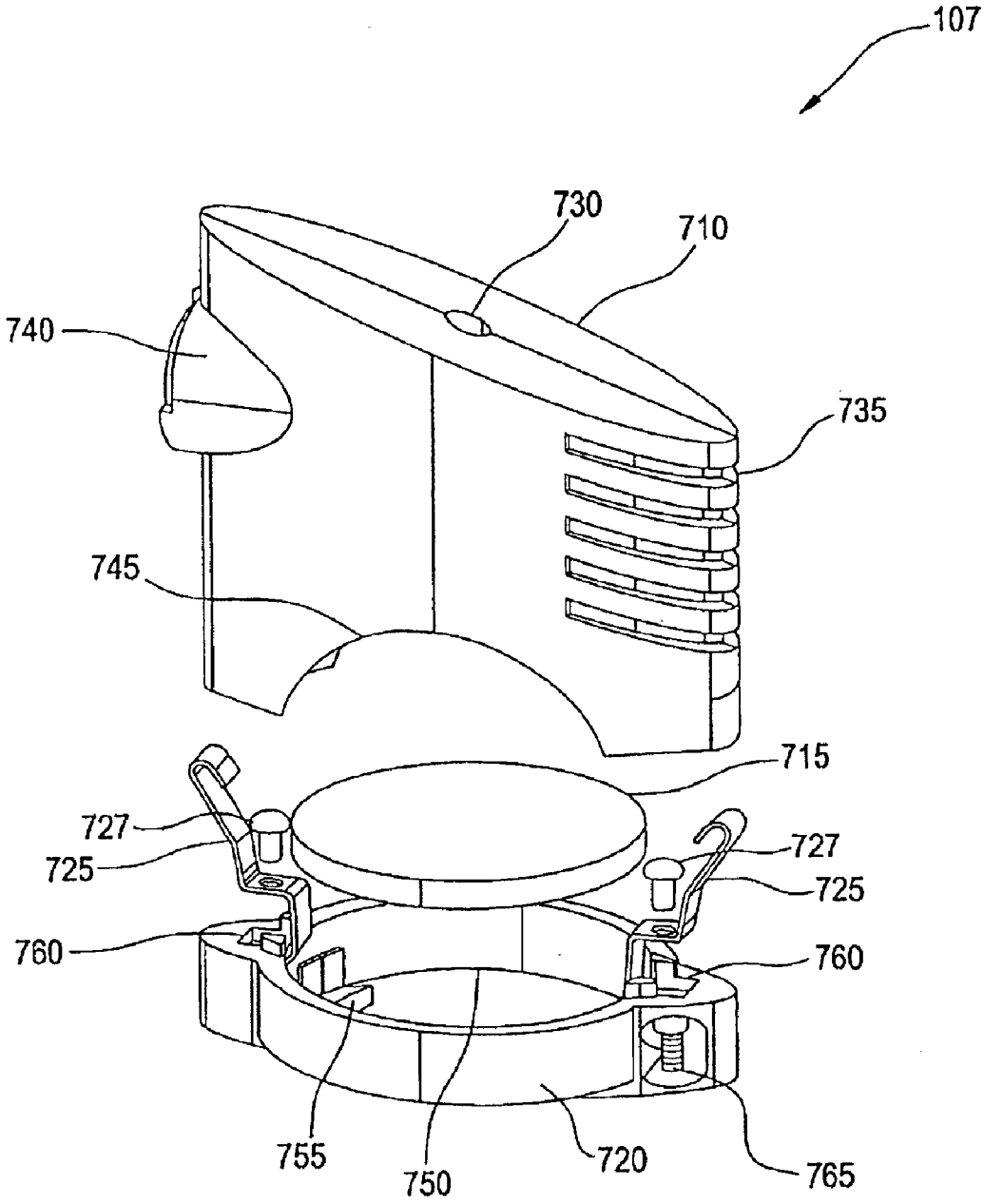
FIG. 22 is an exploded perspective view of a lamp holder with an integral lens retention spring.
Figure 23:
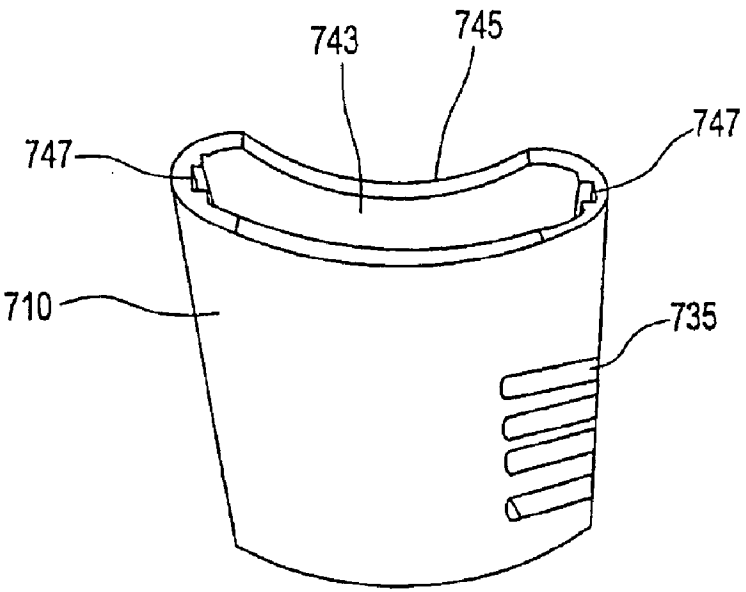
FIG. 23 is a perspective view of a housing for the lamp holder with an integral lens retention spring.

As shown in FIG. 22, a lamp holder 107 with the integral lens retention spring includes a housing 710, a lens 715, a lens frame 720, lens mounting springs 725, and mounting screws 727. The lens mounting springs 725 are mountable to the lens frame 720 and are configured to retain the lens 715 in the lens frame 720 and to attach the lens frame 720 to the housing 710. The housing 710 includes a wiring hole 730, fins 735, a mounting platform 740, and cut-out areas 745. As illustrated in FIG. 23, the housing 710 also includes a cavity 743 with recessed channels 747. As described below, the recessed channels 747 are sized to receive the lens mounting springs 725 when the housing 710 is mounted to the lens frame 720.

As shown in FIG. 22, the lens frame 720 is a circular ring with a lens aperture 750, retaining tabs 755 and a mounting notch 760 with a hole 765 in a wall of the lens frame 720. The lens 715 may be made of transparent or translucent materials, such as, for example, plastic or glass. Lens 715 may have a color filter and/or optical characteristics. For example, lens 715 may be a gel filter or dichroic filter in colors such as red, yellow, ultraviolet, amber, green, blue, or daylight. Optical filters may include diffuse, sandblasted, soft focus, prismatic spread, or linear spread lenses.

Figure 24:
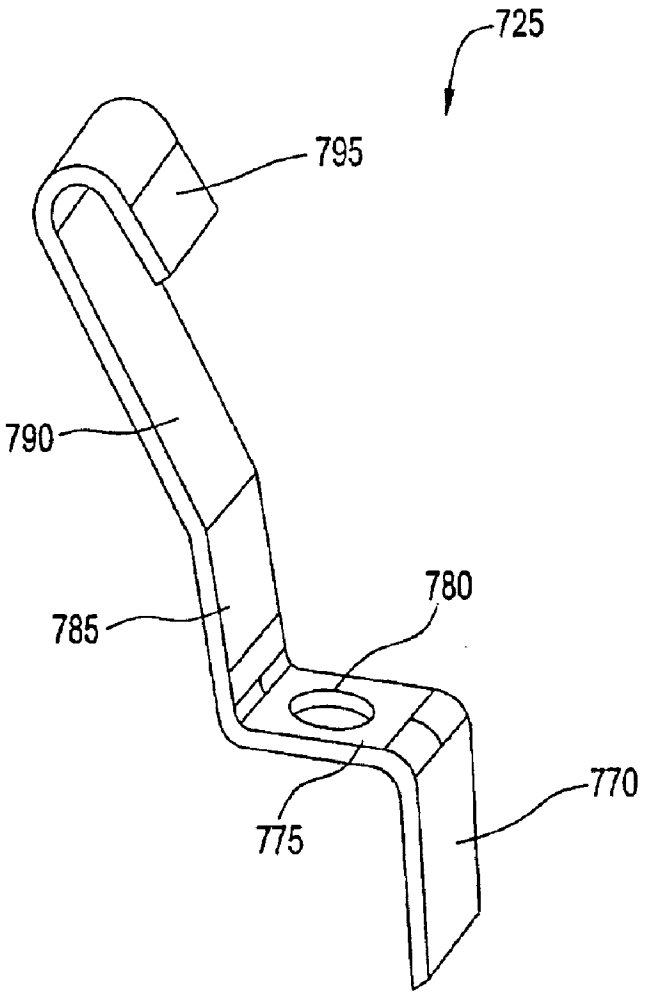
FIG. 24 is a perspective view of a lens mounting spring for the lamp holder with an integral lens retention spring.

Referring to FIG. 24, the lens mounting spring 725 includes a foot or first section 770, a seat or second section 775 with a screw hole 780, an elbow or third section 785, a mounting arm or fourth section 790, and a hook or curved section 795. The second section 775 is generally perpendicular to the first section 770. The third section 785 is generally perpendicular to the second section 775. The fourth section 790 extends away at an angle from the third section 785. The hook or curved section 795 is configured to ease and direct sliding of the mounting spring into the housing 710. The lens mounting spring 725 attaches to the lens frame 720 by inserting the seat 775 of the lens mounting spring 725 into the mounting notch 760 in the lens frame 720. The mounting screws 727 then are passed through the screw holes 780 in the seat 775 and threaded into the hole 765 (FIG. 22) to secure the lens mounting springs 725 to the lens frame 720. The holes 765 can be threaded or non-threaded when, for example, the screws 777 are self-tapping.

Figure 25:
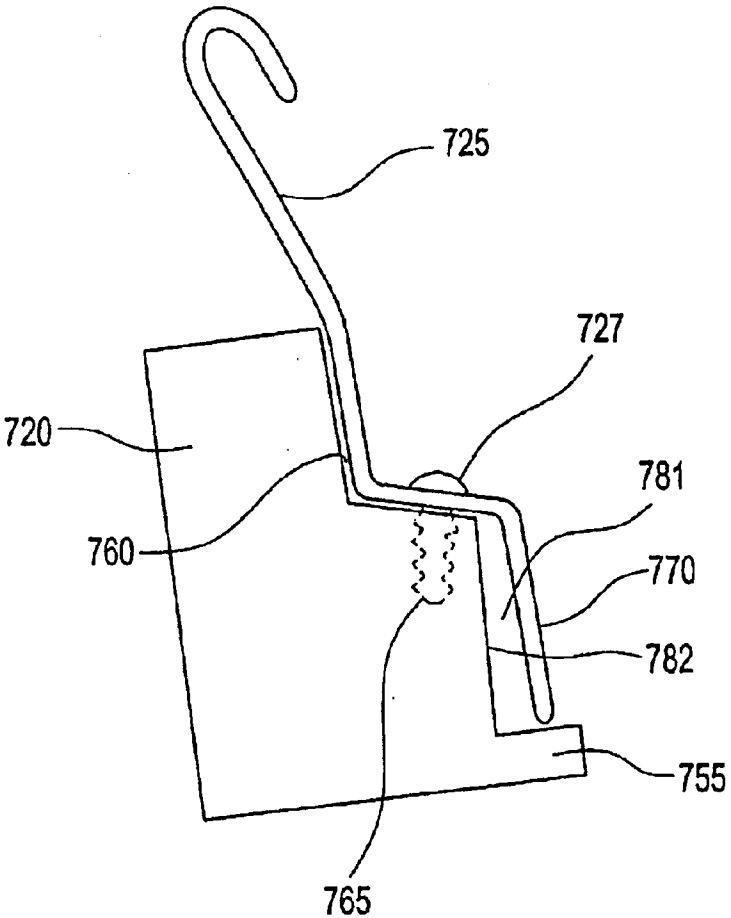

FIG. 25 shows a cut-away view of the lens mounting spring 725 secured to the lens frame 720. As shown, a gap 781 is formed between the foot 770 of the lens mounting spring 725 and a side wall 782 of the mounting notch 760.

Figure 26:
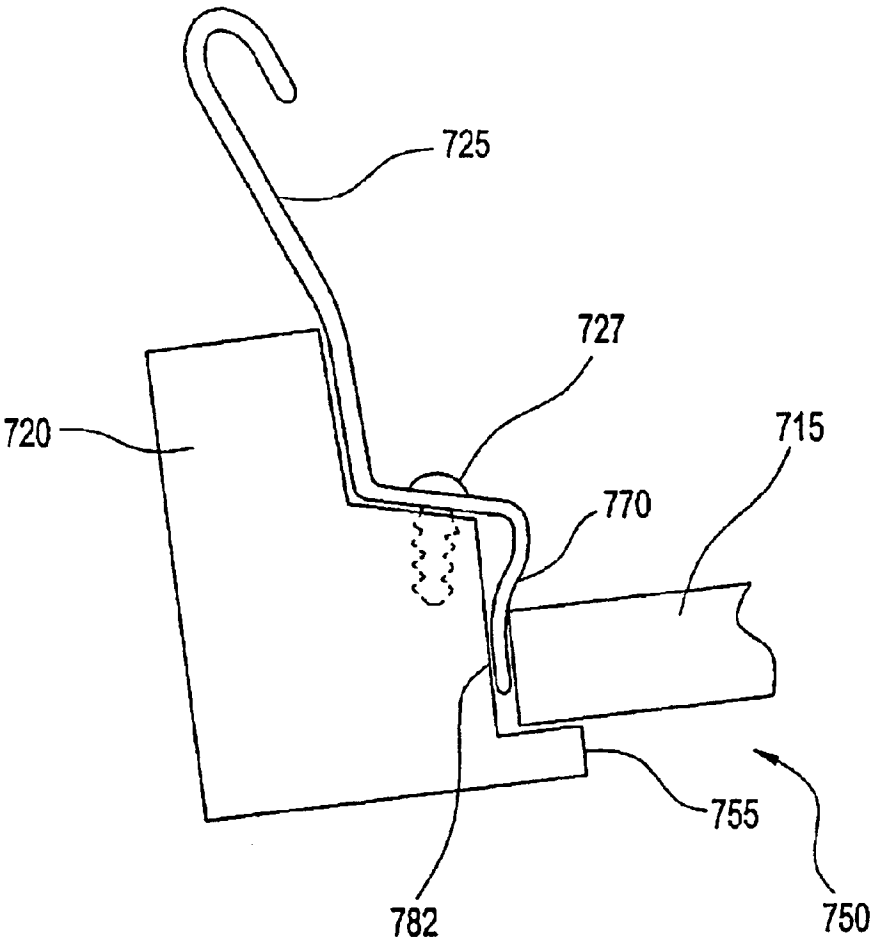
FIGS. 25-27 are cut-away views of the lens mounting spring and the housing.
Figure 27:
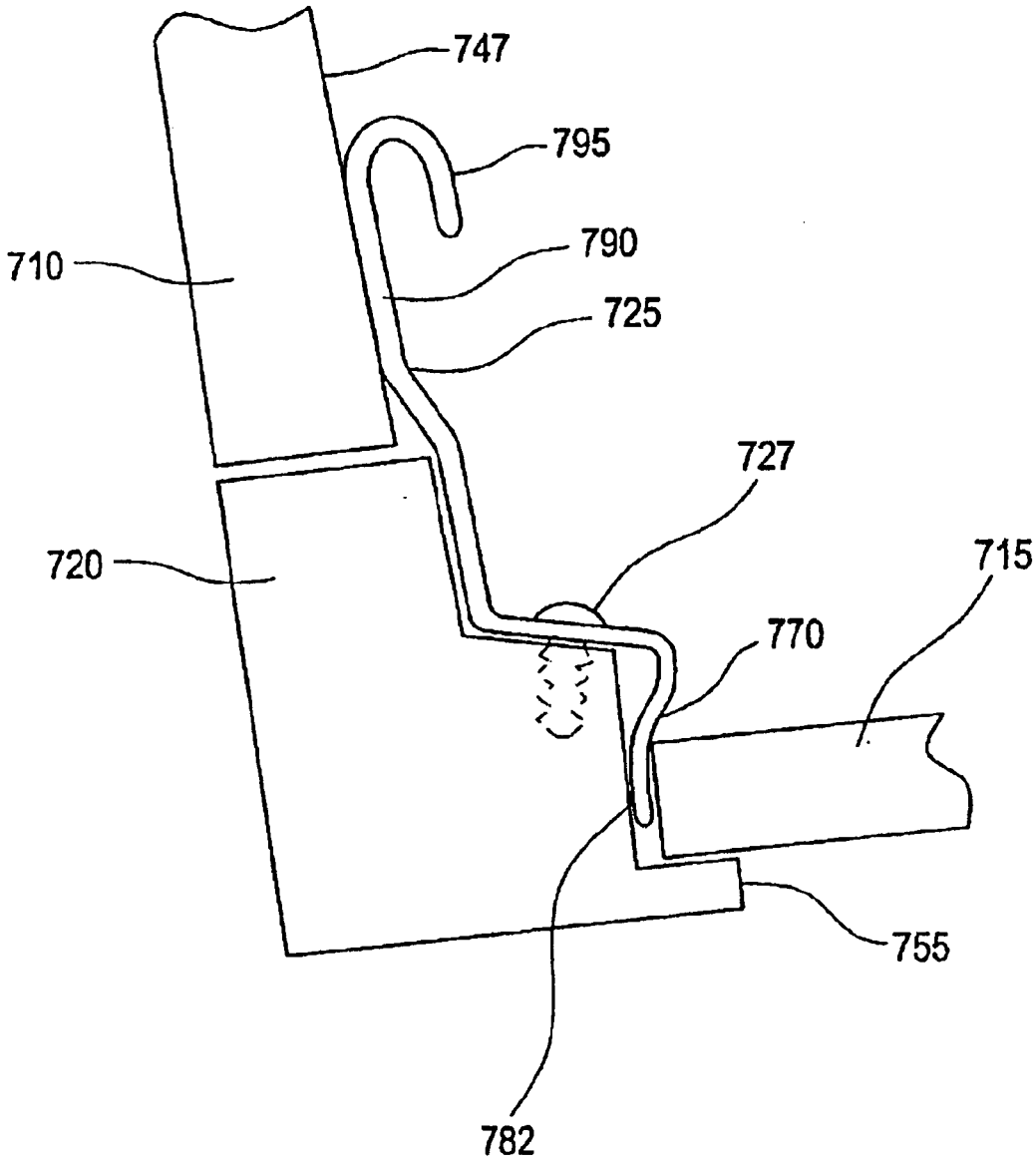

Referring to FIG. 26, the lens 715 is pushed down into the lens frame 720 until the lens 715 contacts the retaining tabs 755 and causes the lower portion of the foot 770 to spring upward and back toward the side wall 782. The lens 715 then is pushed away from the side wall 782 by the foot 770 and down into the lens aperture 750 until the lens 715 contacts the retaining tabs 755. The retaining tabs 755 limit movement of the lens 715 in a first direction and the mounting springs 725 limit the movement of the lens 715 in a second direction. Thus, the lens 715 is fixed inside the lens frame 720 by the tension against the lens 715 by the foot 770. Finally, referring to the cut-away view in FIG. 27, the lens frame 720 is attached to the housing 710 by pushing the mounting arms 790 and hooks 795 into the recessed channels 747 in the cavity 743 of the housing 710. Tension created by bowing in a portion of the mounting arms 790 against the recessed channels 747 fixes the lens frame 720 to the housing 710.

Figure 28:
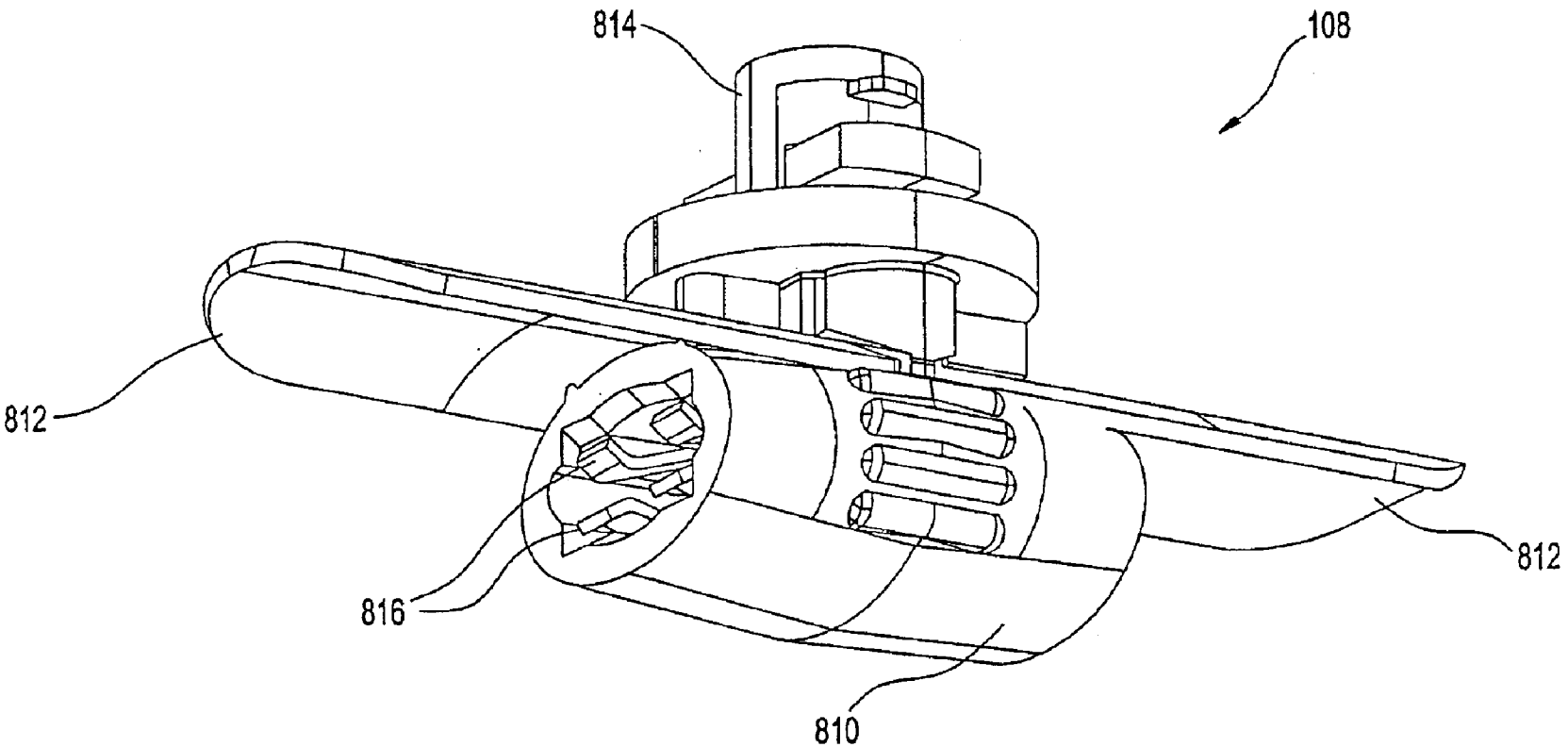
FIGS. 28-30 are perspective and exploded views of wedge base lamp holders.
Figure 29:
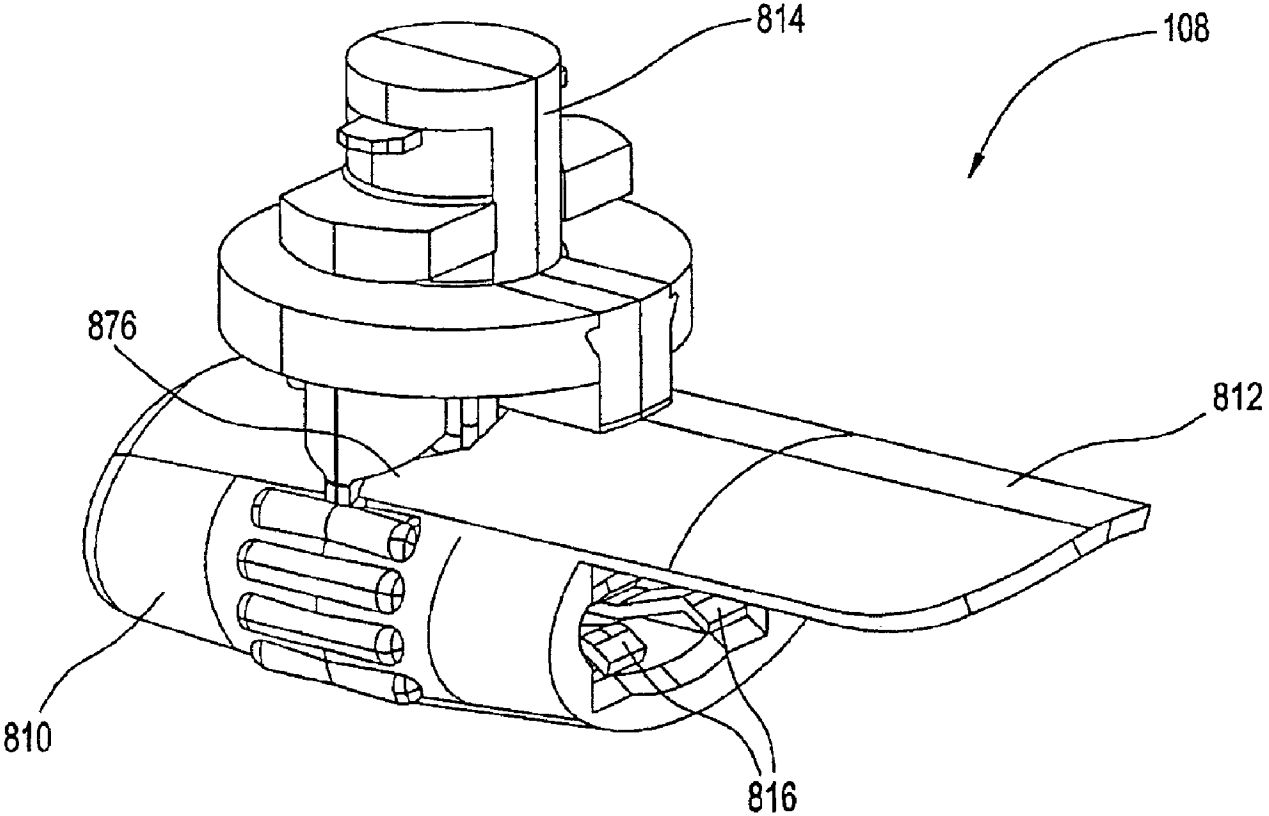

Referring to FIGS. 28-31, a wedge-base lamp holder 108 includes a holder 810, one or two reflectors 812, a retention plug 814, and electrical contact clips 816. For example, FIG. 28 illustrates the lamp holder 108 with two reflectors 812 and FIG. 29 illustrates the lamp holder with one reflector 812.

Figure 30:
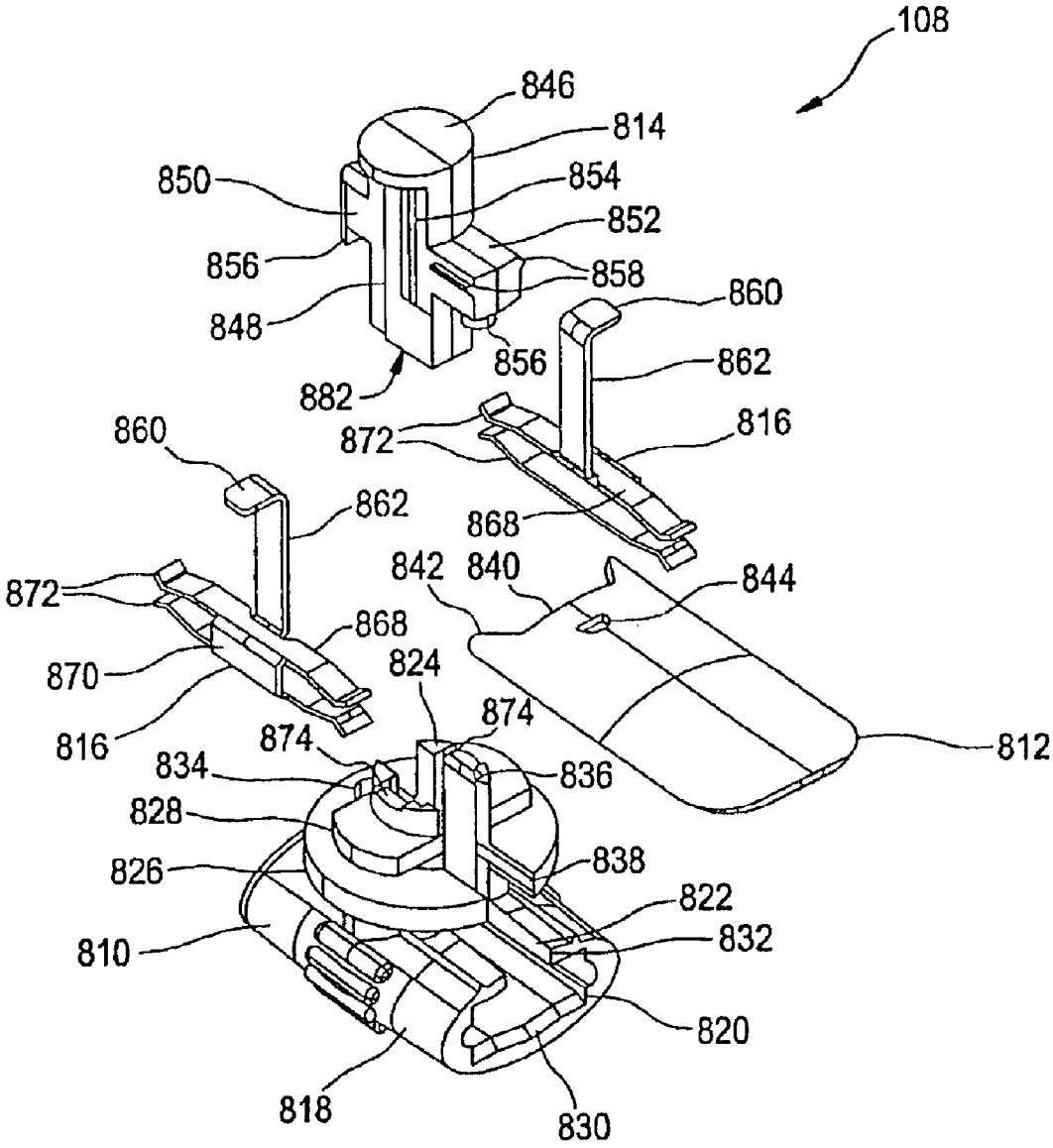

Referring to FIG. 30, the holder 810 includes a body 818, a shaped channel 820, an open channel 822, a stem 824, a stop disk 826, and a rotation disk 828. In the wedge base lamp holder 108 with one reflector 812, the shaped channel 820 extends through one end 832 of the body 818. The end of the shaped channel 820 has an angled ramp 830. The open channel 822 extends from the open end 832 to a channel termination 834 near the opposite end of the body 818. The open channel 822 extends upward through the stem 824, the stop disk 826, and the rotation disk 828.

The lamp holder 810 also includes two vertical alignment grooves 836 that extend from the top of the stem 824 downward to the shaped channel 820. The lamp holder 810 also includes locking grooves 838 in the stop disk 826 that extend from the stem 824 to the outer edge of the stop disk 826.

The reflector 812 has an insertion end 840 with two insertion prongs 842. The reflector also has a semi-circular insertion hole 844 near the insertion end 840. The insertion hole 844 is used to mount the reflector 812 to the body 818, as described below.

The retention plug 814 includes a cap 846, a base 848, an insert arm 850, and a retaining arm 852. The base 848 includes two insert rails 854 that extend from the cap 846 to approximately midway down the base 848. The base 848 also includes an insert tab 882 on the side opposing the cap 846.

The insert arm 850 includes a retaining tab 856 that branches downward from the end of the insert arm 850. The retaining arm 852 includes two locking rails 858 that extend from the base 848 to the end of the retaining arm 852. Each locking rail 858 has a flat top edge and an angled bottom edge. The retaining arm 852 also includes a retaining tab 856 that branches downward from the end of the retaining arm 852.

Each contact clip 816 includes a tongue 860, a riser 862, contact fingers 868, and a coupling wall 870. The contact fingers 868 include angled portions 872 at the ends with a section of the contact finger 868 bent downward and another section of the contact finger 868 bent upward.

The wedge-base lamp holder 108 is assembled by inserting the contact fingers 868 on the contact clips 816 into the shaped channel 820. The tongues 860 are placed facing outward and resting in recesses 874 at the top of the stem 824. The reflectors 812 then are placed on top of the base 848 with the insertion ends 840 facing the center of the lamp holder 810. The insertion prongs 842 on the reflector 812 are slid into insertion grooves 876 (FIG. 29) located at the bottom of the stem 824 where the stem 824 meets the body 818.

Next, the retention plug 814 is inserted down into the body 818 with the insert arm 850 facing the channel termination 834 and the retention arm 852 facing the open end 832. The insert rails 854 on the retention plug 814 are aligned with and inserted into the alignment grooves 836 in the stem 824 of the body 818. Also, the retaining tabs 856 on the insert arm 850 and the retaining arm 852 of the retention plug 814 slide into the insertion holes 844 in the reflectors 812.

Figure 31:
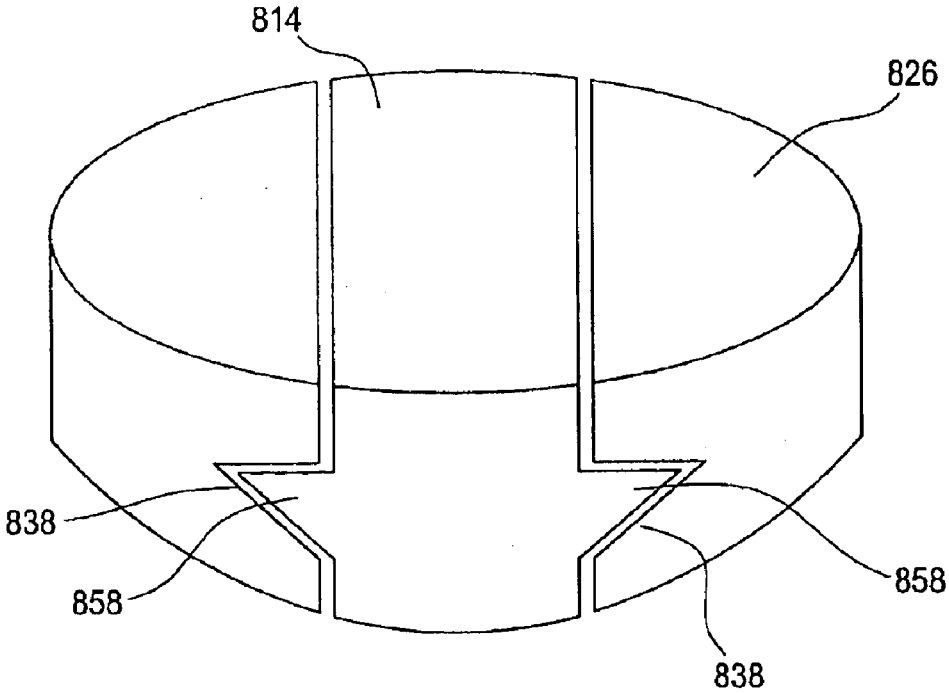
FIG. 31 shows a top-portion of a retention plug inserted in a stop disk for the wedge base lamp holder.
Figure 32:
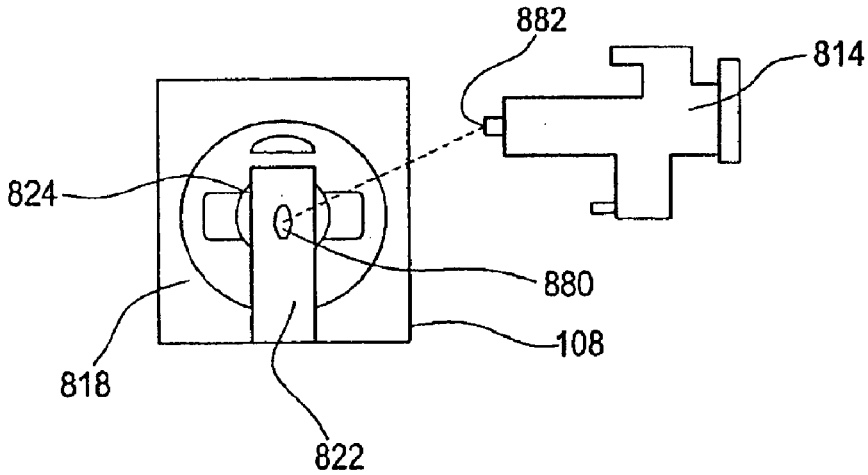
FIG. 32 shows a retention plug and holder for the wedge base lamp holder.

As illustrated in FIGS. 31 and 32, as the retention plug 814 slides downward into the holder 810, the locking rails 858 on the retention plug 814 lock into the locking grooves 838 on the stop disk 826 and the insert tab or extension 882 on the base 848 fits into a notch or slot 880 in the bottom of the shaped channel 820. Inserting the extension 882 within the base slot 880 limits the movement of the retention plug 814 relative to the body 818.

The wedge-base lamp holder 108 is installed in the track network in a manner similar to that of the interface 103 shown in FIG. 9. The wedge-base lamp holder 108 is installed into the track network 101 with the cap 846 facing the track network 101 and is inserted into the opening 113. The tongues 860 of the contact clips 816 are placed in the lower channel 120 and the rotation disk 828 is placed in the upper channel 115. The stop disk 826 rests on the track frame 112 above the opening 113 to prevent over-insertion of the wedge-base lamp holder 108 in the track network 101. The wedge-base lamp holder 108 is rotated approximately 90 degrees relative to the track frame 112, tightly wedging the rotation disk 828 into the upper channel 115 and causing the tongues 860 of the contact clips 816 to make an electrical connection with the track network conductors 125.

Figure 33:
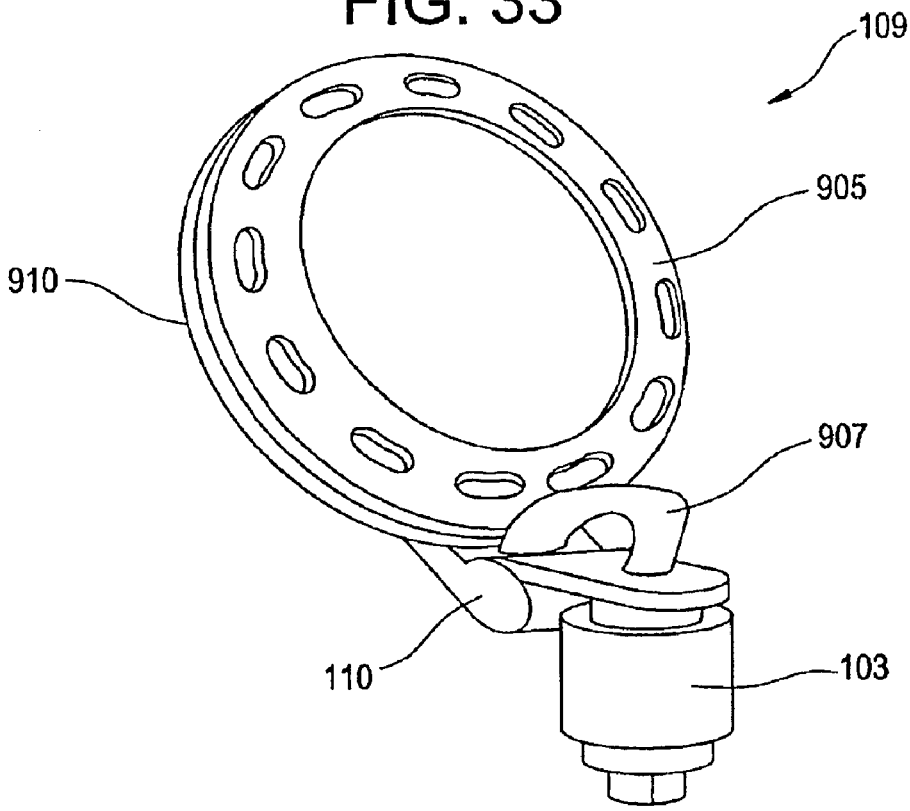
FIG. 33 is a perspective view of a rotation lock housing fixture.

Referring to FIG. 33, a rotation lock light fixture 109 includes a front housing 905, a rear housing 910, a pivot mechanism 110 that operates in the same way as the pivot mechanism 106 described above with respect to FIG. 18, an electrical wire 907, and an interface 103 (as described above with respect to FIG. 9). The rotation lock light fixture 109 is useful in applications such as under cabinet or cove lighting. For example, the light fixture can be pivoted to illustrate the wall behind and underneath a cabinet. It also can be used to illustrate a work area under the cabinet.

Referring to FIG. 34, the front housing 905 includes a lens 912, a lens aperture 914, a front lip 916, a front edge 918, a front cavity 920, engagement arms 922, vents 924, and ridges 926. Referring also to FIG. 35, the rear housing 910 includes a rear lip 928, engagement platforms 930, a rear edge 932, a rear cavity 934, reflector braces 936, posts 938, screw mounts 940, a contact platform 942, vents 944, an arm 946, and a portion 988 of the pivot mechanism 110. The front housing 905 and the rear housing 910 are configured to be mated, as described below. The mated housings 905 and 910 are further configured such that the vents 924 and 944 on the respective housings are aligned for air circulation and cooling within the mated housings 905, 910. For example, as heated air rises and passes through the vents 924 in the front housing 905, cool air will be pulled into the vents 944 in the rear housing 910. However, the vents 924 and 944 can be configured in other arrangements to cause the air to pass laterally through the housings 905, 910 before passing out of the housings. Moreover, the number and shape of the vents 924 and 944 can be varied for functional and decorative purposes.

Figure 36:
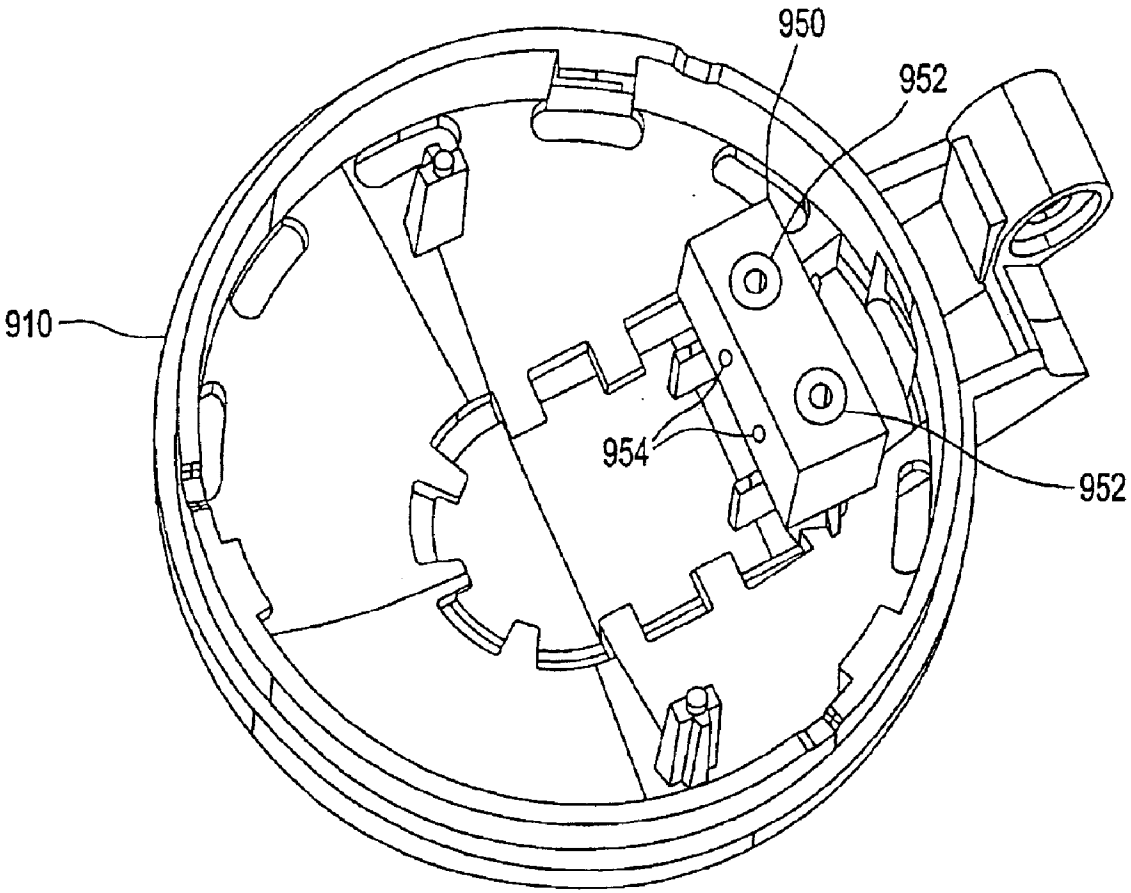

Referring to FIG. 36, a contact block 950 is mounted on the contact platform 942 of the rear housing 910. The contact block 950 has a wiring clip and wiring holes (not shown) for connection to external electrical wiring. The contact block 950 also has mounting holes 952 for mounting the contact block 950 to the rear housing 910 and bulb insert holes 954 for inserting light bulb conductors into the contact block 950.

Figure 37:
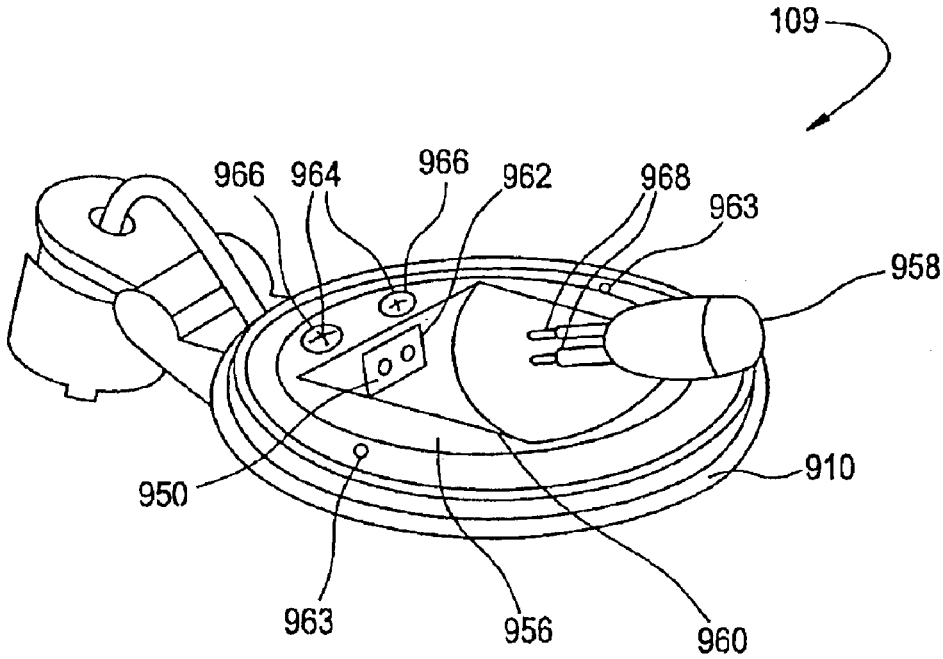

Referring to FIG. 37, the rotation lock light fixture 109 also includes a reflector 956 and a light bulb 958 installed in the rear housing 910. The reflector 956 includes a recess 960, a contact opening 962, brace holes 963, and mounting holes 964. The reflector 956 is prepared for mounting to the rear housing 910 by aligning the brace holes 963 with the reflector braces 936 on the rear housing 910 and putting the posts 938 into the brace holes 963. The contact block 950 and the reflector 956 are attached to the rear housing with screws 966 that are inserted into the mounting holes 964 on the reflector 956 and inserted into the mounting holes 952 on the contact block 950. The screws then are threaded down into the screw mounts 940 on the rear housing 910. Next, conductor tips 968 on the light bulb 958 are passed through the contact opening 962 on the reflector 956 and inserted into the bulb insert holes 954 on the contact block 950.

Figure 38:
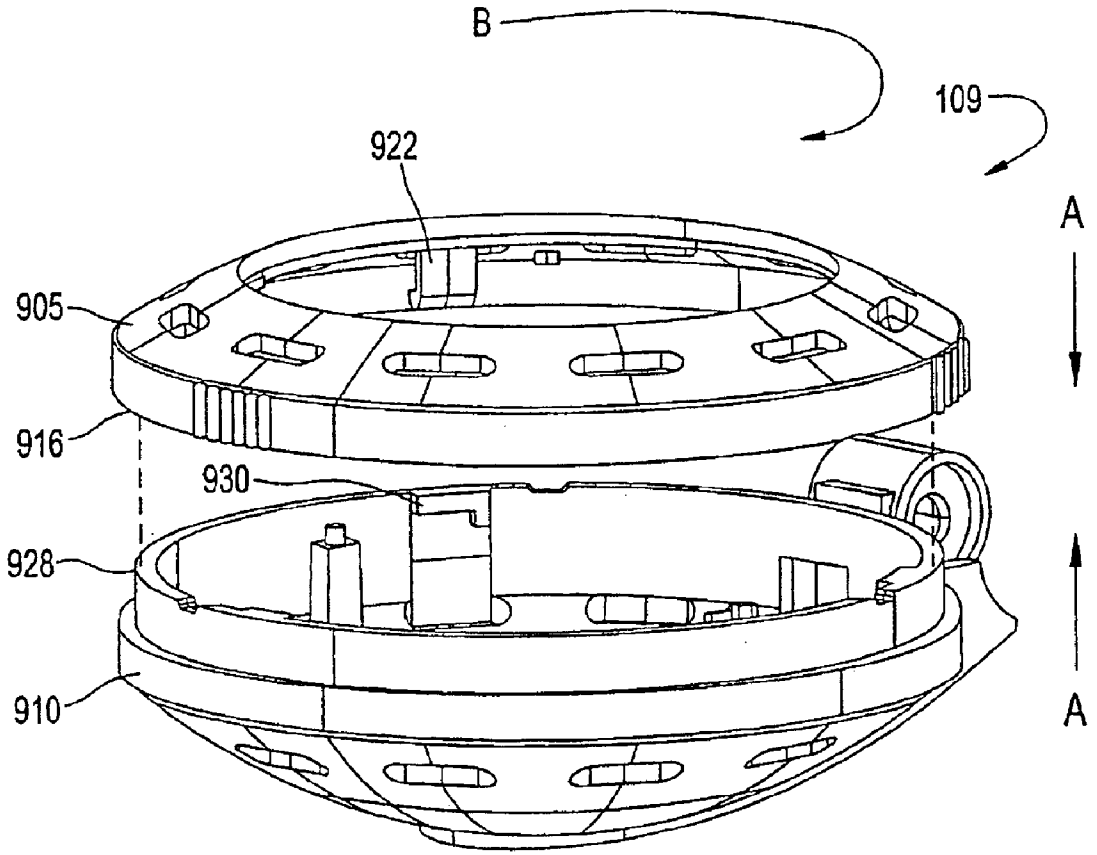
FIG. 38 illustrates assembly of the rotation lock light fixture lamp holder with an integral lens retention spring.

Referring to FIG. 38, the rotation lock light fixture 109 is assembled by aligning the engagement arms 922 on the front housing 905 with the engagement platforms 930 on the rear housing 910. The front housing 905 and the rear housing 910 then are pressed together as represented by Arrow A sp that the front lip 916 overlaps the rear lip 928 and the front edge contacts the rear edge. The front housing 905 is then rotated in a clockwise direction as represented by Arrow B while the rear housing 910 is held in a fixed position until the engagement arm 922 are locked into the engagement platforms 930.

A number of implementations have been described. Other implementations are within the scope of the following claims.

What is claimed is:

1. A lamp holder for attaching to a track frame of a track lighting system, the lamp holder comprising:

a base having a lamp channel for receiving a lamp;

an electrically conductive contact member having a first portion and a second portion, the first portion of the contact member arranged in the lamp channel for contacting the lamp, the second portion of the contact member for contacting an electrical conductor in the track frame;

a retention piece for securing the contact member within the base; and an adaptor portion connected to the base, the adaptor portion having a retention piece channel for receiving the retention piece;

wherein the contact member further comprises a third portion connecting the first portion to the second portion, the third portion arranged in the retention pieces channel.

2. The lamp holder of claim 1, wherein the adaptor portion further comprises a pair of wings releasably engaged with the track frame.

3. The lamp holder of claim 1, wherein the base further comprises a slot at a lower surface of the lamp channel and the retention piece comprises a protrusion positioned within the slot for restricting lateral movement of the retention piece.

4. The lamp holder of claim 1, further comprising a second contact member having a first portion and a second portion, the first portion of the contact members arranged in the lamp channel for contacting the lamp, each second portion of the contact members removably arranged within the track frame for contacting a respective electrical conductor in the track frame.

5. The lamp holder of claim 4, wherein the first portions of the contact members are arranged for contacting a second lamp.

6. The lamp holder of claim 5, further comprising a pair of reflectors for reflecting light radiating from the lamps away from the track frame.

7. A lamp bolder attachable to a track frame of a track lighting system, the lamp holder comprising:

means, having a lamp channel, for receiving a lamp within the lamp channel;

means for contacting the lamp in the lamp channel and for removably contracting an electrical conductor in the track frame;

means for securing the contacting means within the receiving means; and means, having a retaining channel, for retaining the securing means within the retaining channel;

wherein the retaining means further comprises means for engaging with the track frame.

8. The lamp holder of claim 7, wherein the contacting means further comprises means for providing electrical power from the electrical conductor in the track frame to the lamp.

9. The lamp holder of claim 7, wherein the receiving means further comprises a slot at a lower surface of the lamp channel and the securing means comprises a protrusion positioned within the slot for restricting lateral movement of the securing means.

10. The lamp holder of claim 7, further comprising second contracting means for contacting the lamp and for removably contracting a second electrical conductor in the track frame.

11. The lamp holder of claim 10, wherein the contracting means and second contracting means are arranged for contracting a second lamp.

12. The lamp holder of claim 11, further comprising mean for reflecting light radiating from the lamps away from the track frame.

13. A track lighting system comprising:

a track frame mounted to a ceiling structure, the track frame comprises an upper channel and a lower channel, the upper channel securing a pair of electrical conductors; and a lamp holder comprising:

a base having a first end, a second end opposite the first end, and a lamp channel extending from the first end to the second end, the base configured to receive a first lamp in the lamp channel through the first end and configured to receive a second lamp in the lamp channel through the second end;

an adaptor portion connected to the base and comprising a channel arranged substantially perpendicular to the lamp channel, the adaptor portion further comprising a pair of wings removably engaged within the lower channel of the track frame;

a pair of electrically conductive contact members, each contact member having a first portion, a second portion, and a third portion, the first portion of each contact member arranged in the lamp channel for contacting the first and second lamps, the second portion of each contact member removably arranged within the upper channel of the track frame for contracting a respective electrical conductor, the third portion of each contact member arranged in the retaining channel for connecting the first portion to the second portion; and a retention piece supported within the retaining channel for securing the contact member within the base.

14. The track lighting system of claim 13, wherein the base further comprises a slot at a lower surface of the lamp channel an the retention piece comprises a positioned within the slot for restricting lateral movement of the retention piece.

15. The track lighting system of claim 13, further comprising a pair of reflectors for reflecting light radiating from the first and second lamps away from the track frame.

* * * * *